US009809031B2

(12) United States Patent
Tomoguchi et al.

(10) Patent No.: US 9,809,031 B2
(45) Date of Patent: Nov. 7, 2017

(54) LIQUID CARTRIDGE

(71) Applicant: BROTHER KOGYO KABUSHIKI KAISHA, Nagoya-shi, Aichi-ken (JP)

(72) Inventors: Suguru Tomoguchi, Okazaki (JP); Kenta Hayashida, Inazawa (JP); Taro Nagano, Nagoya (JP); Ayako Ohishi, Nagoya (JP); Hirofumi Kondo, Aichi-ken (JP); Hiroto Sugahara, Ama (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/492,290

(22) Filed: Sep. 22, 2014

(65) Prior Publication Data

US 2016/0039213 A1 Feb. 11, 2016

(30) Foreign Application Priority Data

Aug. 8, 2014 (EP) ..... 14180409

(51) Int. Cl.
*B41J 2/175* (2006.01)

(52) U.S. Cl.
CPC ..... *B41J 2/17503* (2013.01); *B41J 2/1752* (2013.01); *B41J 2/17513* (2013.01); *B41J 2/17523* (2013.01); *B41J 2/17543* (2013.01)

(58) Field of Classification Search
None
See application file for complete search history.

(56) References Cited

U.S. PATENT DOCUMENTS

| | | | |
|---|---|---|---|
| 4,677,845 | A | 7/1987 | Izumi et al. |
| 4,862,192 | A | 8/1989 | Slomianny |
| 5,502,467 | A | 3/1996 | Hoisington et al. |
| 6,033,065 | A | 3/2000 | Ikezaki |

(Continued)

FOREIGN PATENT DOCUMENTS

| | | | |
|---|---|---|---|
| DE | 69911718 | T2 | 7/2004 |
| DE | 602004000993 | T2 | 9/2006 |

(Continued)

OTHER PUBLICATIONS

Notice of Allowance issued in related related U.S. Appl. No. 14/492,261, dated Jun. 1, 2015.

(Continued)

*Primary Examiner* — Justin Seo
(74) *Attorney, Agent, or Firm* — Merchant & Gould P.C.

(57) ABSTRACT

A liquid cartridge includes a liquid chamber, a partitioning wall partitioning the liquid chamber into a first liquid chamber and a second liquid chamber, a communication opening through which liquid can flow from the first liquid chamber to the second liquid chamber, and a movable member which is movable between a block position and a communication position. When the movable member is in the block position, the movable member is configured to prevent the liquid from flowing from the first liquid chamber to the second liquid chamber through the communication opening, and when the movable member is in the communication position, the liquid is allowed to flow from the first liquid chamber to the second liquid chamber through the communication opening.

14 Claims, 17 Drawing Sheets

(56) References Cited

U.S. PATENT DOCUMENTS

| | | | | |
|---|---|---|---|---|
| 6,378,971 | B1 | 4/2002 | Tamura et al. | |
| 6,786,581 | B1 | 9/2004 | Shinada et al. | |
| 7,278,722 | B2 | 10/2007 | Sasaki et al. | |
| 8,272,724 | B2 | 9/2012 | Kanbe | |
| 2001/0006396 | A1* | 7/2001 | Iida | B41J 2/17503 347/86 |
| 2004/0104984 | A1 | 6/2004 | Hall et al. | |
| 2004/0179056 | A1 | 9/2004 | Katayama | |
| 2005/0140749 | A1 | 6/2005 | Usui et al. | |
| 2005/0146579 | A1* | 7/2005 | Sasaki | B41J 2/17513 347/86 |
| 2005/0151812 | A1 | 7/2005 | Sasaki et al. | |
| 2005/0243110 | A1 | 11/2005 | Takahashi et al. | |
| 2006/0066698 | A1 | 3/2006 | Takatsuka | |
| 2006/0290753 | A1* | 12/2006 | Tatsumi | B41J 2/17513 347/85 |
| 2007/0236546 | A1 | 10/2007 | Sugahara | |
| 2010/0165024 | A1 | 7/2010 | Abergel | |
| 2011/0001773 | A1 | 1/2011 | Bianco et al. | |
| 2012/0182365 | A1 | 7/2012 | Ma | |
| 2013/0321538 | A1* | 12/2013 | Ishizawa | B41J 2/17506 347/86 |

FOREIGN PATENT DOCUMENTS

| | | | |
|---|---|---|---|
| DE | 602004008402 | T2 | 12/2007 |
| DE | 102009026107 | A1 | 1/2011 |
| DE | 202010017253 | U1 | 7/2011 |
| EP | 0282049 | A2 | 9/1988 |
| EP | 803 364 | A2 | 10/1997 |
| EP | 1 053 878 | A1 | 11/2000 |
| EP | 1 462 263 | A2 | 9/2004 |
| EP | 1570995 | A1 | 9/2005 |
| EP | 2 783 862 | A2 | 10/2014 |
| JP | 63-135253 | A | 6/1988 |
| JP | 9-109408 | A | 4/1997 |
| JP | 9-277560 | A | 10/1997 |
| JP | 2001-232806 | A | 8/2001 |
| JP | 2004-202872 | A | 7/2004 |
| JP | 2005-153285 | A | 6/2005 |
| JP | 2006-27257 | A | 2/2006 |
| JP | 2010-214687 | A | 9/2010 |

OTHER PUBLICATIONS

Related U.S. Appl. No. 14/492,261, as filed.

Extended European Search Report issued in related EP 14180409.6, dated Oct. 16, 2014.

Extended European Search Report issued in related EP 14180408.8, dated Oct. 9, 2014.

Office Action issued in related German Patent Application No. 10 2014 224 327.0 dated Oct. 15, 2015.

Office Action issued in related German Patent Application No. 10 2014 224 328.9 dated Oct. 15, 2015.

Notification of the First Office Action from related Chinese Patent Office for Chinese patent application No. 201510043507.X, dated Mar. 17, 2017.

Notification of the First Office Action from related Chinese Patent Office for Chinese patent application No. 201510043586.4, dated May 3, 2017.

* cited by examiner

LIQUID CARTRIDGE

CROSS REFERENCE TO RELATED APPLICATION

The present application claims priority to and the benefit of European Patent Application No. 14180409.6, which was filed on Aug. 8, 2014, the disclosure of which is incorporated herein by reference in its entirety.

BACKGROUND OF THE INVENTION

1. Field of the Invention

The present invention relates to a liquid cartridge.

2. Description of Related Art

A known ink-jet recording apparatus is configured to record an image on a recording medium by ejecting ink stored in an ink container from nozzles. The viscosity of ink stored in the ink container may change over time. A known ink-jet recording apparatus, as described in Patent Application Publication No. JP-09-277560 A, is configured to estimate the viscosity of ink stored in an ink container, and perform optimized preliminary ejection based on the result of the estimation. More specifically, the ink-jet recording apparatus is configured to estimate the viscosity of ink based on an elapsed time since the ink container is mounted to the ink-jet recording apparatus and an amount of ink remaining in the ink container. Nevertheless, this known ink-jet recording apparatus does not estimate the viscosity by directly measuring a physical quantity obtained when ink moves in the ink container. Moreover, this known ink-jet recording apparatus cannot estimate the viscosity of ink stored in an ink container which has not been mounted to the ink-jet recording apparatus and been unused.

SUMMARY OF THE INVENTION

Therefore, a need has arisen for a liquid cartridge which overcomes these and other shortcomings of the related art. A technical advantage of the present invention is that the viscosity of liquid stored in a liquid cartridge may be estimated by more direct measurement.

According to an aspect of the present invention, a liquid cartridge comprises: a first outer face; a second outer face opposite the first outer face; a liquid chamber positioned between the first outer face and the second outer face and configured to store liquid therein, a liquid supply portion positioned at the first outer face and configured to supply the liquid from an interior of the liquid chamber to an exterior of the liquid chamber; a partitioning wall partitioning the liquid chamber into a first liquid chamber and a second liquid chamber, a communication opening through which the liquid can flow from the first liquid chamber to the second liquid chamber; and a movable member which is movable between a block position and a communication position. When the movable member is in the block position, the movable member is configured to prevent the liquid from flowing from the first liquid chamber to the second liquid chamber through the communication opening, and when the movable member is in the communication position, the liquid is allowed to flow from the first liquid chamber to the second liquid chamber through the communication opening.

With this configuration, when the movable member moves from the block position to the communication position, the liquid moves from the first liquid chamber to the second liquid chamber through the communication opening. The flow rate of the liquid moving from the first liquid chamber to the second liquid chamber varies depending on the viscosity of liquid in the liquid chamber. By measuring a physical quantity, based on which the flow rate of the liquid can be specified, the viscosity of liquid stored in the liquid chamber may be estimated.

According to another aspect of the present invention, a liquid cartridge comprises: a first outer face; a second outer face opposite the first outer face; a liquid chamber positioned between the first outer face and the second outer face and configured to store liquid therein, a liquid supply portion positioned at the first outer face and configured to supply the liquid from an interior of the liquid chamber to an exterior of the liquid chamber; a partitioning wall partitioning the liquid chamber into a first liquid chamber and a second liquid chamber, wherein the partitioning wall has a first thickness; a communication opening through which the liquid can flow from the first liquid chamber to the second liquid chamber; and a rupturable wall closing the communication opening, wherein the rupturable wall has a second thickness which is less than the first thickness.

With this configuration, when rupturable wall is ruptured, the liquid moves from the first liquid chamber to the second liquid chamber though the communication opening. The flow rate of the liquid moving from the first liquid chamber to the second liquid chamber varies depending on the viscosity of liquid in the liquid chamber. By measuring a physical quantity, based on which the flow rate of the liquid can be specified, the viscosity of liquid stored in the liquid chamber may be estimated.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-17B, like numerals being used for like corresponding parts in the various drawings.

[Printer 10]

Figure 1:
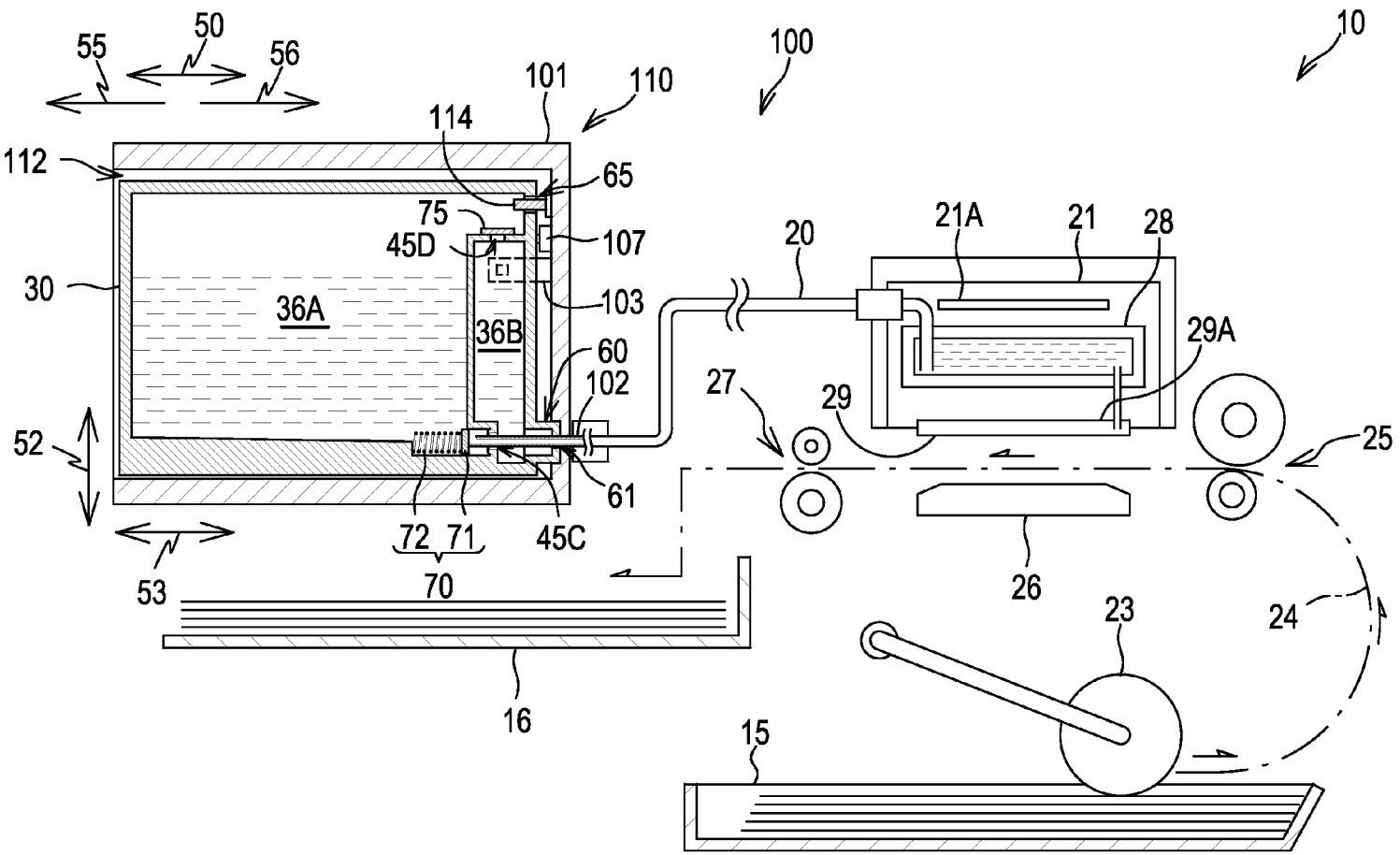
FIG. 1 is a schematic, cross-sectional view of a printer comprising a cartridge mounting portion and an ink cartridge, according to an embodiment of the present invention.

Referring to FIG. 1, a liquid consuming apparatus, such as an ink jet printer 10 is configured to record an image on a sheet of recording paper by ejecting ink droplets selectively on the sheet of recording paper. The printer 10 comprises a liquid consuming portion, e.g., a recording head 21, an ink supply device 100, and an ink tube 20 connecting the recording head 21 and the ink supply device 100. The ink supply device 100 comprises a cartridge mounting portion 110. The cartridge mounting portion 110 is configured to allow a liquid container or a liquid cartridge, e.g., an ink cartridge 30 to be mounted therein. The cartridge mounting portion 110 has an opening 112 and the interior of the cartridge mounting portion 110 is exposed to the exterior of the cartridge mounting portion 110 via opening 112. The ink cartridge 30 is configured to be inserted into the cartridge mounting portion 110 via the opening 112 in an insertion direction 56, and to be removed from the cartridge mounting portion 110 via the opening 112 in a removal direction 55.

The ink cartridge 30 is configured to store ink, which is used by the printer 10. The ink cartridge 30 and the recording head 21 are fluidically connected via the ink tube 20 when mounting of the ink cartridge 30 to the cartridge mounting portion 110 has been completed. The recording head 21 comprises a sub tank 28. The sub tank 28 is configured to temporarily store ink supplied via the ink tube 20 from the ink cartridge 30. The recording head 21 comprises nozzles 29 and is configured to selectively eject ink supplied from the sub tank 28 through the nozzles 29. More specifically, the recording head 21 comprises a head control board 21A and piezoelectric actuators 29A corresponding to the nozzles 29, and the head control board 21A is configured to selectively apply driving voltage to the piezoelectric actuators 29A. As such, ink is ejected from the nozzles 29.

The printer 10 comprises a paper feed tray 15, a paper feed roller 23, a conveying roller pair 25, a platen 26, a discharge roller pair 27, and a discharge tray 16. A conveying path 24 is formed from the paper feed tray 15 up to the discharge tray 16 via the conveying roller pair 25, the platen 26, and the discharge roller pair 27. The paper feed roller 23 is configured to feed a sheet of recording paper from the paper feed tray 15 to the conveying path 24. The conveying roller pair 25 is configured to convey the sheet of recording paper fed from the paper feed tray 15 onto the platen 26. The recording head 21 is configured to selectively eject ink onto the sheet of recording paper passing over the platen 26. Accordingly, an image is recorded on the sheet of recording paper. The sheet of recording paper having passed over the platen 26 is discharged by the discharge roller pair 27 to the paper discharge tray 16 disposed at the most downstream side of the conveying path 24.

[Ink Supply Device 100]

Figure 2:
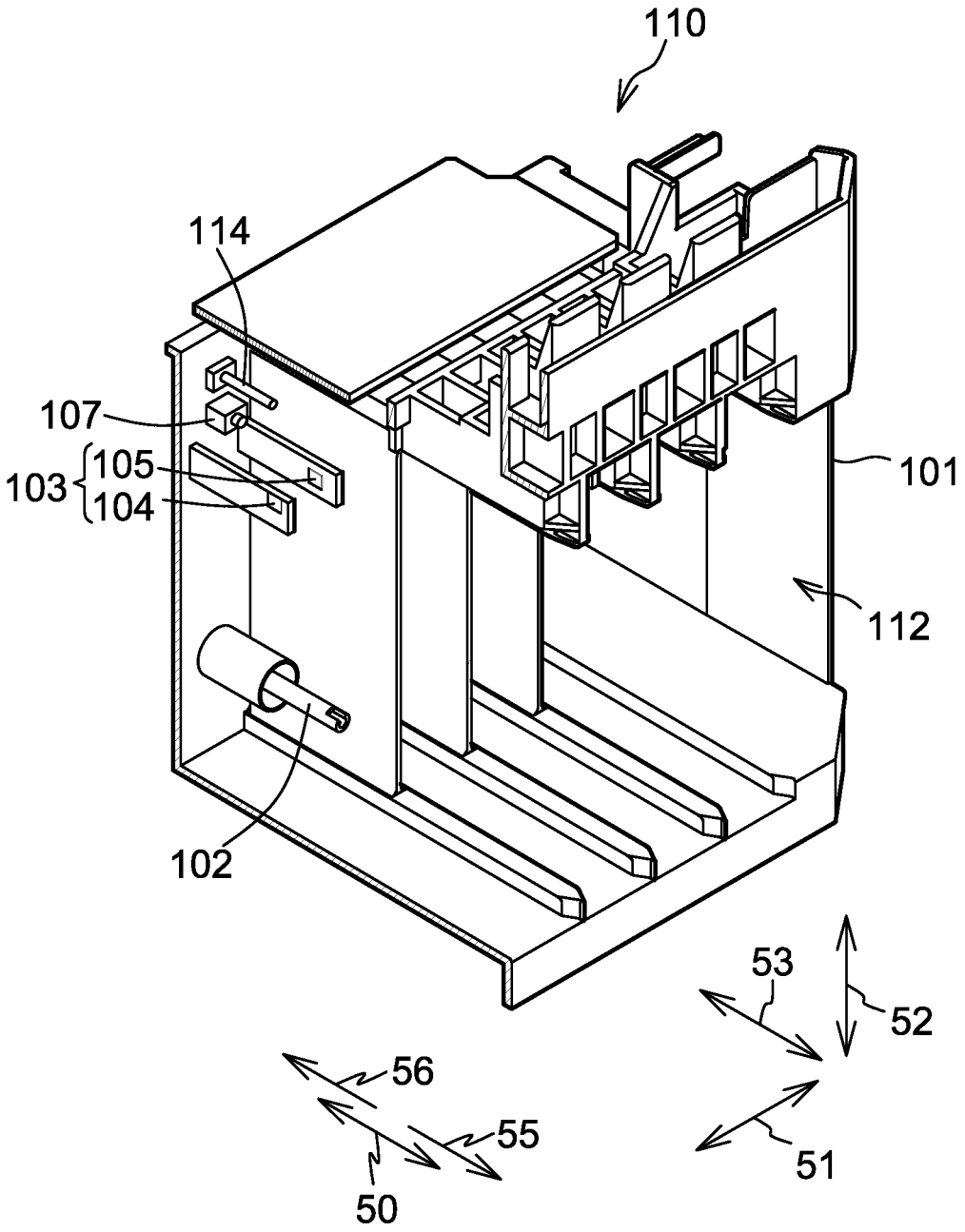
FIG. 2 is a perspective view of the cartridge mounting portion which is partly cut, showing an end surface of the cartridge mounting portion.

Referring to FIG. 1, the printer 10 comprises the ink supply device 100. The ink supply device 100 is configured to supply ink to the recording head 21. The ink supply device 100 comprises the cartridge mounting portion 110 to which the ink cartridge 30 is mountable. The cartridge mounting portion 110 comprises a case 101, a longitudinal object, e.g., a hollow tube 102, a detector, e.g., a sensor 103, a mount detector, e.g., a mount sensor 107, and a rod 114. In FIG. 1, mounting of the ink cartridge 30 to the cartridge mounting portion 110 has been completed. Referring to FIG. 2, the illustrated example of the cartridge mounting portion 110 is configured to receive four ink cartridges 30 storing cyan, magenta, yellow, and black inks, respectively. Four hollow tubes 102, four sensors 103, four mount sensors 107, and four rods 114 are provided at the cartridge mounting portion 110, corresponding to the four ink cartridges 30.

[Hollow Tube 102]

The case 101 of the cartridge mounting portion 110 has the opening 112 formed through one face of the case 101. The case 101 comprises an end surface opposite the opening 112. Referring to FIGS. 1 and 2, the hollow tube 102 extends from the end surface of the case 101 in the removal direction 55. The hollow tube 102 is positioned at the end surface of the case 101 and at a position corresponding to an ink supply portion 60 (described later) of the ink cartridge 30. The hollow tube 102 is a resin tube having a liquid path formed therein. The hollow tube 102 has a proximal end and a distal end. The hollow tube 102 has an opening formed through a distal-end side of the hollow tube 102, and the ink tube 20 is connected to a proximal-end side of the hollow tube 102. When the hollow tube 102 is inserted into the ink supply portion 60 of the ink cartridge 30, ink stored in the ink cartridge 30 is allowed to flow into the ink tube 20 via the hollow tube 102.

The printer 10 comprises a cover (not shown) configured to selectively cover the opening 112 of the cartridge mounting portion 110 and not cover the opening 112 such that the opening 112 is exposed to the exterior of the printer 10. The cover is supported by the case 101 or by an outer case of the printer 10 such that the cover can be selectively opened and closed. When the cover is opened, the opening 112 is exposed to the exterior of the printer 10. When the cover is opened, a user can insert the ink cartridge 30 into the cartridge mounting portion 110 through the opening 112 and can remove the ink cartridge 30 from the cartridge mounting portion 110 through the opening 112. When the cover is closed, the opening 112 is covered and the ink cartridge 30 cannot be inserted into or removed from the cartridge mounting portion 110.

In this description, when it is described that the ink cartridge 30 is mounted to the cartridge mounting portion 110, it means that at least a portion of the ink cartridge 30 is positioned in the cartridge mounting portion 110, more specifically, positioned in the case 101. Therefore, an ink cartridge 30 which is being inserted into the cartridge mounting portion 110 is also an example of an ink cartridge 30 mounted to the cartridge mounting portion 110. On the other hand, when it is described that the mounting of the ink cartridge 30 to the cartridge mounting portion 110 has been completed, it means that the ink cartridge 30 is in such a state that the printer 10 can perform image recording. For instance, when the ink cartridge 30 is in such a state, ink supply from the ink cartridge 30 to the recording head 21 is at least possible, and preferably the ink cartridge 30 is locked such that the movement of ink cartridge 30 relative to the cartridge mounting portion 110 is restricted or the ink cartridge 30 is positioned in the cartridge mounting portion 110 with the cover closed.

[Sensor 103]

Referring to FIG. 2, the sensor 103 is positioned above the hollow tube 102 and extends from the end surface of the case 101 in the removal direction 55. The sensor 103 comprises a light emitting portion 104 and a light receiving portion 105 aligned in a width direction 51. The light emitting portion 104 and the light receiving portion 105 face each other in the width direction 51. The light emitting portion 104 is configured to emit light, e.g., visible, infrared, and/or ultraviolet light, toward the light receiving portion 105, and the light receiving portion 105 is configured to receive the light emitted by the light emitting portion 104. When the mounting of the ink cartridge 30 to the cartridge mounting portion 110 has been completed, the ink cartridge 30 is positioned between the light emitting portion 104 and the light receiving portion 105. In other words, the light emitting portion 104 and the light receiving portion 105 are provided so as to face each other with the ink cartridge 30 positioned therebetween when the mounting of the ink cartridge 30 to the cartridge mounting portion 110 has been completed.

In this embodiment, a detection position is a position within the ink cartridge 30 which intersects an imaginary line extending between the light emitting portion 104 and the light receiving portion 105 when the mounting of the ink cartridge 30 to the cartridge mounting portion 100 has been completed. In other words, the detection position intersects an optical path extending between the light emitting portion 104 and the light receiving portion 105. In other words, the sensor 103 is positioned so as to face the detection position. In this embodiment, the sensor 103 is positioned so as to face the ink cartridge 30 when the mounting of the ink cartridge 30 to the cartridge mounting portion 110 has been completed. In another embodiment, the sensor 103 is positioned so as to face the ink cartridge 30 when the ink cartridge 30 is being inserted into the cartridge mounting portion 110. That is, the sensor 103 is positioned so as to face the ink cartridge 30 mounted to the cartridge mounting portion 110, and the detection position intersects the optical path extending between the light emitting portion 104 and the light receiving portion 105 when the ink cartridge 30 is mounted to the cartridge mounting portion 110.

The sensor 103 is configured to output different detection signals based on the intensity of light received by the light receiving portion 105. The sensor 103 is configured to output a Low-level signal, i.e., a signal whose level is less than a predetermined threshold value, when the intensity of light received by the light receiving portion 105 is less than a predetermined intensity. The sensor 103 is configured to output a High-level signal, i.e., a signal whose level is greater than or equal to the predetermined threshold value, when the intensity of light received by the light receiving portion 105 is greater than or equal to the predetermined intensity.

[Mount Sensor 107]

Referring to FIGS. 1 and 2, the mount sensor 107 is positioned in a mount detection position in an insertion path of the ink cartridge 30 in the cartridge mounting portion 110. The ink cartridge 30 moves in the insertion path when the ink cartridge 30 is inserted into the cartridge mounting portion 110. In this embodiment, the mount sensor 107 is positioned at the end surface of the case 101. The mount sensor 107 is configured to output different detection signals based on the presence or absence of the ink cartridge 30 in the mount detection position. In this embodiment, the mount sensor 107 is positioned, such that the ink cartridge 30 is positioned in the mount detection position when the mounting of the ink cartridge 30 to the cartridge mounting portion 100 has been completed.

In this embodiment, the mount sensor 107 is a mechanical sensor. When the mount sensor 107 is not pushed by a front wall 40 (described later) of the ink cartridge 30, the mount sensor 107 outputs a Low-level signal, indicating that the ink cartridge 30 is not in the mount detection position. When the mount sensor 107 is pushed by the front wall 40 of the ink cartridge 30, the mount sensor 107 outputs a High-level signal, indicating that the ink cartridge 30 is in the mount detection position. The mount sensor 107 is not limited to the mechanical sensor, but may be an optical sensor, an electric sensor, or any other known sensor.

[Rod 114]

Referring to FIGS. 1 and 2, the rod 114 is positioned above the hollow tube 102 and extends from the end surface of the case 101 in the removal direction 55. The rod 114 is positioned at the end surface of the case 101 and at a position corresponding to an air communication opening 65 (described later) of the ink cartridge 30. When the rod 114 is inserted through the air communication opening 65, the inside of the ink cartridge 30 is brought into fluid communication with the atmosphere outside the ink cartridge 30.

[Ink Cartridge 30]

Figure 3A:
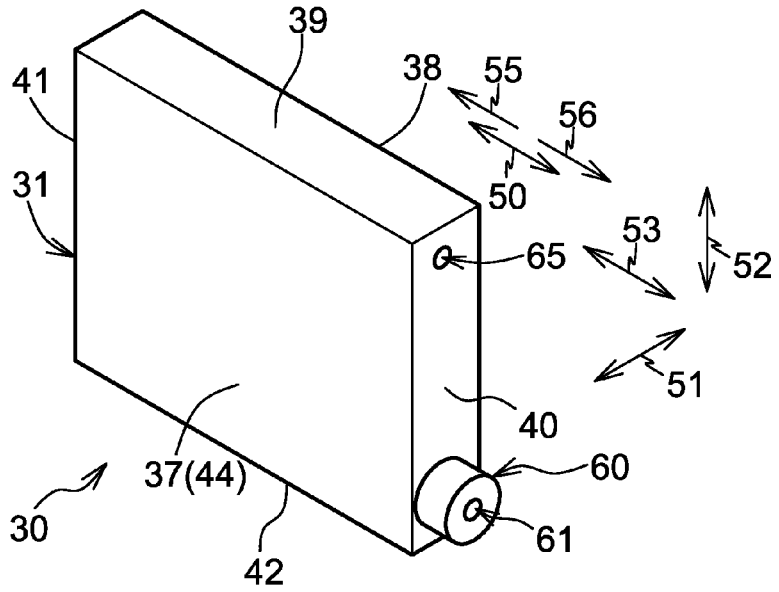
FIG. 3A is a perspective view of the ink cartridge, in which a film is welded to a frame.
Figure 3B:
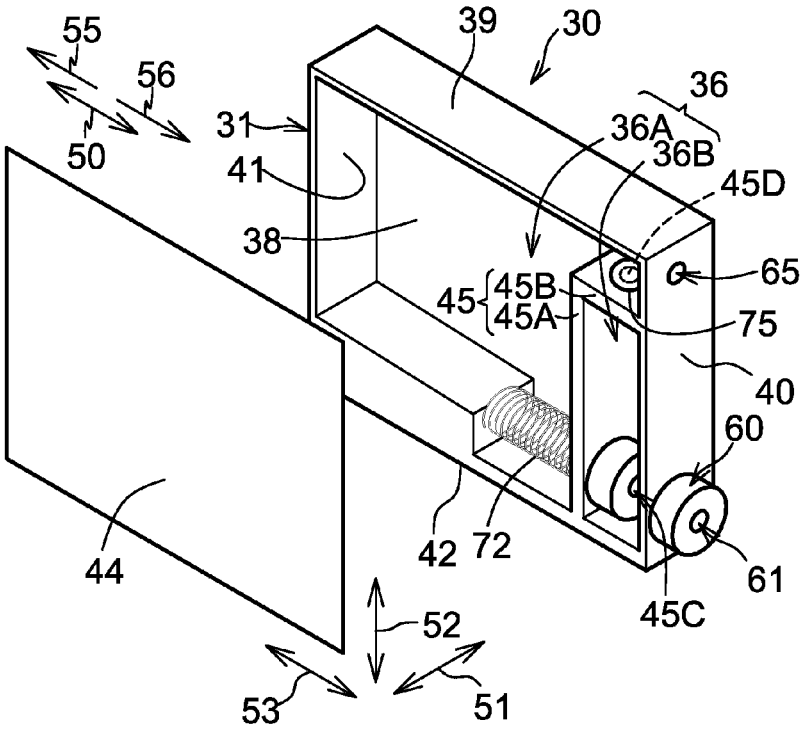
FIG. 3B is an exploded perspective view of the ink cartridge, in which the film is removed from the frame.

Referring to FIGS. 3A and 3B, the ink cartridge 30 comprises a frame 31 having a liquid chamber, e.g., an ink chamber 36 formed therein, and a liquid supply portion, e.g., an ink supply portion 60 extending from the frame 31. The ink cartridge 30 is configured to supply ink stored in the ink chamber 36 to the exterior of the ink cartridge 30 via the ink supply portion 60. The ink cartridge 30 is configured to be inserted into and removed from the cartridge mounting portion 110 in an insertion-removal direction 50, while the ink cartridge 30 is in an upright position, as shown in FIG. 3A, with a top face of the ink cartridge 30 facing upward and a bottom face of the ink cartridge 30 facing downward. In this embodiment, the insertion-removal direction 50 extends in a horizontal direction. The insertion direction 56 is an example of the insertion-removal direction 50. The removal direction 55 is an example of the insertion-removal direction 50. The insertion direction 56 and the removal direction 55 are opposite directions. In another embodiment, the insertion-removal direction 50 may not extend exactly in a horizontal direction but may extend in a direction intersecting a horizontal direction and the vertical direction.

The frame 31 has substantially a rectangular parallelepiped shape, and its dimension in a width direction (left-right direction) 51 is less than each of its dimension in a height direction (up-down direction) 52 and its dimension in a depth direction (front-rear direction) 53. The width direction 51, the height direction 52, and the depth direction 53 are perpendicular to each other. The width direction 51 extends in a horizontal direction. The depth direction 53 extends in a horizontal direction. The height direction 52 extends in the vertical direction. The insertion-removal direction 50 is parallel with the depth direction 53. The frame 31 comprises a front wall 40, a rear wall 41, a top wall 39, a bottom wall 42, and a right wall 38. The front wall 40 and the rear wall 41 at least partly overlap when viewed in the depth direction 53. The top wall 39 and the bottom wall 42 at least partly overlap when viewed in the height direction 52. The right wall 38 is positioned on one side of the frame 31 with respect to the width direction 51. In this embodiment, the right wall 38 is positioned on the right side of the frame 31 when the frame 31 is viewed from the front-wall 40 side. When the ink cartridge 30 is inserted into the cartridge mounting portion 110, the front wall 40 is positioned at the front side of the ink cartridge 30, and the rear wall 41 is positioned at the rear side of the ink cartridge 30. When the ink cartridge 30 is inserted into the cartridge mounting portion 110, the front wall 40 is oriented toward the insertion direction 56, and the rear wall 41 is oriented toward the removal direction 55. The rear wall 41 is positioned away from the front wall 40 in the removal direction 55. The frame 31 comprises a front outer face, a rear outer face, a top outer face, a bottom outer face, and a right outer face. The front wall 40 comprises the front outer face, the rear wall 41 comprises the rear outer face, the top wall 39 comprises the top outer face, the bottom wall 42 comprises the bottom outer face, and the right wall 38 comprises the right outer face.

The top wall 39 is connected to the upper end of the front wall 40, the upper end of the rear wall 41, and the upper end of the right wall 38. The bottom wall 42 is connected to the lower end of the front wall 40, the lower end of the rear wall 41, and the lower end of the right wall 38. The right wall 38 is connected to the right end of the front wall 40, the right end of the rear wall 41, the right end of the top wall 39, and the right end of the bottom wall 42. The other side of the frame 31 with respect to the width direction 51 is opened. In this embodiment, the left side of the frame 31, which is positioned on the left side of the frame 32 when the frame 31 is viewed from the front-wall 40 side, is opened. The frame 31 comprises a partitioning wall 45 extending from the inner surface of the right wall 38 in the width direction 51 toward the left side of the frame 31. The partitioning wall 45 comprises a first wall 45A extending in the height direction 52 and a second wall 45B extending in the depth direction 53. The first wall 45A extends substantially in parallel with the front wall 40, and the second wall 45B extends substantially in parallel with the top wall 39. The first wall 45A is positioned away from the front wall 40 in the depth direction 53. The first wall 45A has an upper end and a lower end connected to the bottom wall 42. The second wall 45B is positioned away from the top wall 39 in the height direction 52. The second wall 45B is connected to the upper end of the first wall 45A at one end and connected to the front wall 40 at the other end. Each wall of the frame 31 allows the light emitted from the light emitting portion 104 of the sensor 103 to pass therethrough.

The ink cartridge 30 comprises a left wall 37 connected to the left side of the frame 31 with respect to the width direction 51. In this embodiment, the left wall 37 is a film 44. The film 44 and the frame 31 have almost the same outer contour when viewed in the width direction 51. The film 44 is welded to the left end of the front wall 40, the left end of the rear wall 41, the left end of the top wall 39, the left end of the bottom wall 42, and the left end of the partitioning wall 45 by heat. As such, it is possible to store ink in the ink chamber 36 defined by the front wall 40, the rear wall 41, the top wall 39, the bottom wall 42, the right wall 38, and the left wall 37 (the film 44). The left wall 37 (the film 44)

allows the light emitted from the light emitting portion 104 of the sensor 103 to pass therethrough. The ink cartridge 30 may comprise a cover covering the film 44 from outside. In such a case, the cover also allows the light emitted from the light emitting portion 104 of the sensor 103 to pass therethrough.

In this embodiment, the ink stored in the ink chamber 36 blocks the light emitted from the light emitting portion 104 of the sensor 103. More specifically, when a body of ink is in the detection position and the light emitted by the light emitting portion 104 of the sensor 103 reaches one side of the body of ink in a direction (the width direction 51) perpendicular to the insertion-removal direction 50, an amount (intensity) of light coming out of the other side of the body of ink and reaching the light receiving portion 105 of the sensor 103 is less than a predetermined amount (intensity), e.g., zero. The blocking of the light is caused by the body of ink completely preventing the light from passing therethrough in width direction 51 perpendicular to the insertion-removal direction 50, by the body of ink absorbing some amount of the light, by the body of ink scattering the light, or by another phenomenon. On the other hand, when the body of ink is not in the detection position and the light emitted by the light emitting portion 104 of the sensor 103 reaches one side of the ink cartridge 30 in the width direction 51 perpendicular to the insertion-removal direction 50, an amount (intensity) of light coming out of the other side of the ink cartridge 30 and reaching the light receiving portion 105 of the sensor 103 is greater than or equal to the predetermined amount (intensity). As such, the amount (intensity) of the light reaching the light receiving portion 105 of the sensor 103 depends on whether the body of ink is in the detection position or not.

[Ink Supply Portion 60]

Referring to FIGS. 1, 3A and 3B, the ink supply portion 60 extends from the front outer face of the front wall 40 in the insertion direction 56. In this embodiment, the ink supply portion 60 has a cylindrical shape. The ink supply portion 60 has a proximal end at the front wall 40 and a distal end opposite the proximal end. The ink supply portion 60 has a liquid supply opening, e.g., an ink supply opening 61 formed at the distal end. The ink supply opening 61 extends in the depth direction 53. The ink supply portion 60 has an inner space and the inner space can be in fluid communication with the exterior of the ink cartridge 30 via the ink supply opening 61. The inner space of the ink supply portion 60 is in fluid communication with the inner space of the frame 31, i.e., the ink chamber 36, at the proximal-end side. The ink chamber 36 can be in fluid communication with the exterior of the ink cartridge 30 via the ink supply portion 60. Before the ink cartridge 30 is mounted to the cartridge mounting portion 110, the ink supply opening 61 is closed by a rupturable wall, e.g., a film 61A (See FIG. 5A). The hollow tube 102 is configured to penetrate and rupture the film 61A when the ink cartridge 30 is mounted to the cartridge mounting portion 110. The film 61A has elasticity, e.g., may be a rubber film. When the hollow tube 102 is inserted through the film 61A, the film 61A tightly contacts the outer surface of the hollow tube 102. When the hollow tube 102 is inserted into the ink supply portion 60 of the ink cartridge 30, ink stored in the ink cartridge 30 is allowed to flow into the ink tube 20 via the hollow tube 102. When the hollow tube 102 is removed from the film 61A, an opening in the film 61A which is formed by the penetration of the hollow tube 102 can be closed by the elasticity of the film 61A.

In this description, when it is described that the ink supply opening 61 is provided at the front wall 40, it at least means that the ink supply opening 61 penetrates through the front wall 40, or that the ink supply opening 61 is provided at the distal end of the ink supply portion 60 extending from the front wall 40 in the insertion direction 56, or that the ink supply opening 61 is provided at a distal end of an protrusion extending from the front wall 40 in the removal direction 55.

[Air Communication Opening 65]

Referring to FIGS. 1, 3A and 3B, the ink cartridge 30 comprises an air communication opening 65 formed through the front wall 40 of the frame 31. The air communication opening 65 is configured to bring the ink chamber 36 into fluid communication with the atmosphere outside the ink cartridge 30. The air communication opening 65 is positioned above the ink supply portion 60 and extends through the front wall 40 of the frame 31 in the depth direction 53. The air communication opening 65 is also positioned above the second wall 45B of the partitioning wall 45. Moreover, the air communication opening 65 is in a position corresponding to the rod 114 of the cartridge mounting portion 110. Before the ink cartridge 30 is mounted to the cartridge mounting portion 110, the air communication opening 65 is closed by a rupturable wall, e.g., a film 65A (See FIG. 5A). The rod 114 is configured to penetrate and rupture the film 65A when the ink cartridge 30 is mounted to the cartridge mounting portion 110. When the rod 114 is inserted through the film 65A and the air communication opening 65, the ink chamber 36, more specifically the first ink chamber 36A, is brought into fluid communication with the atmosphere outside the ink cartridge 30 through the air communication opening 65.

In this description, when it is described that the air communication opening 65 is provided at the front wall 40, it at least means that the air communication opening 65 penetrates through the front wall 40, or that the air communication opening 65 is provided at a distal end of an protrusion extending from the front wall 40 in the insertion direction 56, or that the air communication opening 65 is provided at a distal end of an protrusion extending from the front wall 40 in the removal direction 55.

[Ink Chamber 36]

Referring to FIGS. 1 and 3B, the ink chamber 36 is partitioned into a first ink chamber 36A and a second ink chamber 36B. In this embodiment, the first ink chamber 36A is positioned farther from the front wall 40 than the first wall 45A is. In other words, the first wall 45A is positioned between the first ink chamber 36A and the front wall 40. Moreover, the second ink chamber 36B is positioned closer to the front wall 40 than the first wall 45A is. In other words, the second ink chamber 36B is positioned between the first wall 45A and the front wall 40. The first ink chamber 36A and the second ink chamber 36B are aligned in the insertion-removal direction 50 sandwiching the first wall 45A therebetween.

The first wall 45A has a communication opening 45C formed therethrough. The communication opening 45C extends in the depth direction 53. The ink supply opening 61 and the communication opening 45C are aligned in the depth direction 53. In other words, the communication opening 45C is on a line passing through the ink supply opening 61 and extending in the depth direction 53 (the removal direction 55). The diameter of the communication opening 45C is greater than the outer diameter of the hollow tube 102. The communication opening 45C is positioned in a lower half portion of the ink cartridge 30. A portion of the first ink chamber 36A and a portion of the second ink chamber 36B are positioned in an upper half portion of the ink chamber 30. Therefore, the portion of the first ink chamber 36A and the portion of the second ink chamber 36B are positioned above the communication opening 45C. The ink cartridge 30 comprises a valve mechanism 70, and the communication opening 45C is selectively opened and closed by the valve mechanism 70. When the communication opening 45C is opened, the first ink chamber 36A and the second ink chamber 36B are brought into fluid communication, such that ink can flow from the first ink chamber 36A to the second ink chamber 36B through the communication opening 45C.

The valve mechanism 70 comprises a movable member 71 and a biasing member, e.g., a coil spring 72. The movable member 71 has a cylindrical shape having a diameter greater than the diameter of the communication opening 45C. The movable member 71 is disposed in the first ink chamber 36A facing the communication opening 45C in the depth direction 53 (the insertion direction 56). The movable member 71 and the ink supply opening 61 are aligned in the depth direction 53. The movable member 71 is movable between a block position and a communication position. When the movable member 71 is in the block position, the movable member 71 contacts a portion of the first wall 45A surrounding the communication opening 45C and thereby blocks the communication opening 45C. When the movable member 71 is in the communication position, the movable member 71 is positioned away from the portion of the first wall 45A surrounding the communication opening 45C and thereby opens the communication opening 45C. In this embodiment, the communication position is closer to the rear outer face of the rear wall 41 than the block position is. The coil spring 72 has a first end contacting a surface of the frame 31 facing in the insertion direction 56 in the first ink chamber 36A and a second end contacting a rear surface of the movable member 71 facing in the removal direction 55. The coil spring 72 is configured to bias the movable member 71 in the insertion direction 56 into the block position. The coil spring 72 is an example of a biasing member and can be replaced with a leaf spring, resin spring, etc.

Before the ink cartridge 30 is mounted to the cartridge mounting portion 110, i.e., when the movable member 71 is initially in the block position, the first ink chamber 36A stores a first initial amount of ink therein and the second ink chamber 36B stores a second initial amount of ink therein. The second initial amount of ink may be zero, i.e., the second ink chamber 36B may not store ink therein. The first initial amount of ink in the first ink chamber 36A has a first initial ink surface, and the second initial amount of ink in the second ink chamber 36B has a second initial ink surface when the second initial amount of ink is not zero. The first initial ink surface is positioned above the second initial ink surface. The second ink chamber 36B has a space to be filled with ink when the communication opening 45C is opened. In this embodiment, the second initial amount is zero.

The second wall 45B has an opening 45D formed therethrough. The ink cartridge 30 comprises an air permeable film 75 attached to the second wall 45B. The air permeable film 75 covers the opening 45D. The air permeable film 75 allows air to pass therethrough, but blocks liquid from passing therethrough. Therefore, air can flow between the first ink chamber 36A and the second ink chamber 36B through the opening 45D, but the flow of ink between the first ink chamber 36A and the second ink chamber 36B through the opening 45D is blocked by the air permeable film 75. The opening 45D and the air permeable film 75 are positioned above the first initial ink surface in the first ink chamber 36A. The air permeable film 75 is a porous film and is made of polytetrafluoroethylene, polychlorotrifluoroethylene, tetrafluoroethylene-hexafluoropropylene copolymer, tetrafluoroethylene-perfluoroalkyl vinyl ether copolymer, tetrafluoroethylene-ethylene copolymer or another known material.

[Controller 130]

Figure 4:
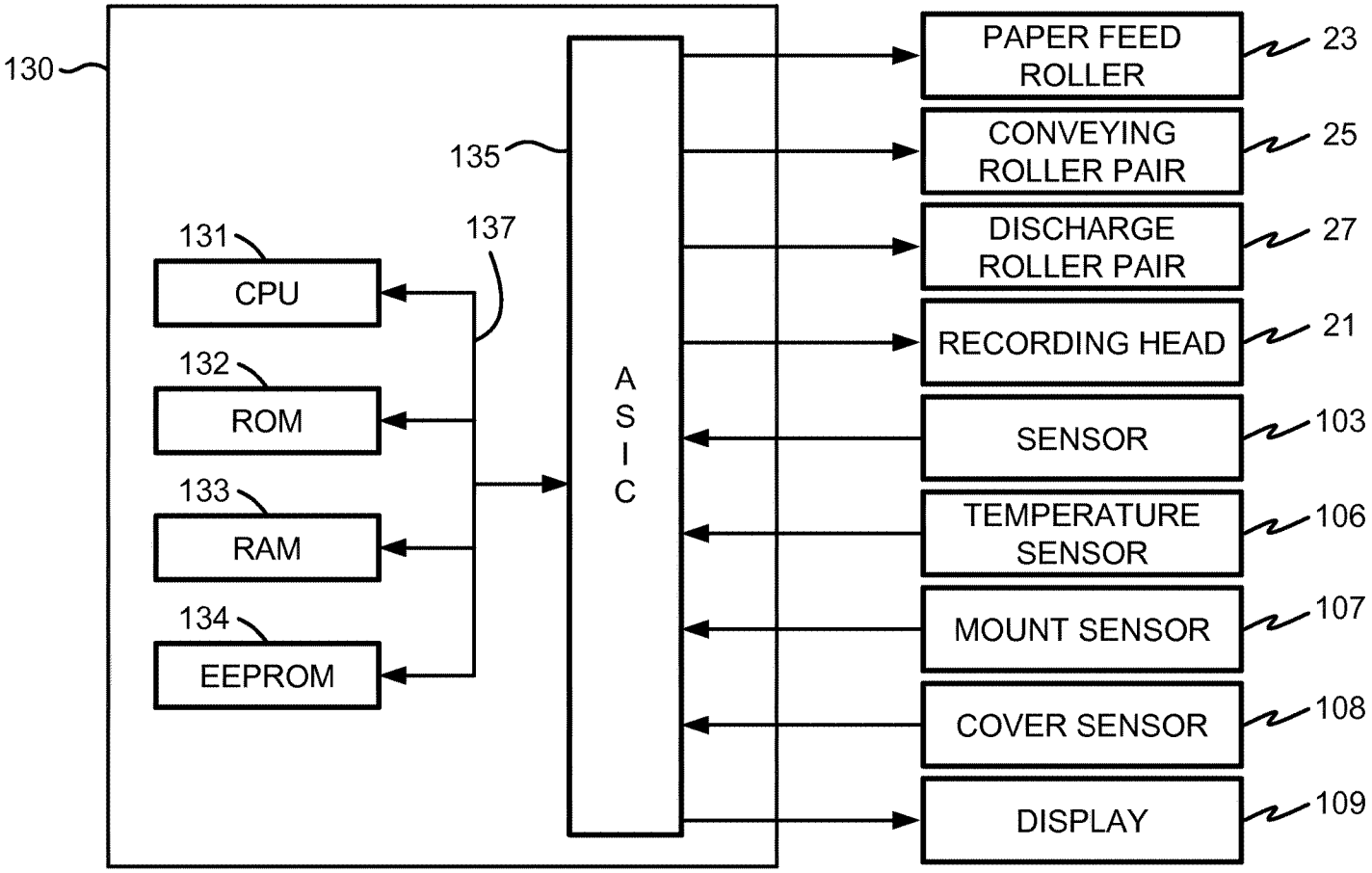
FIG. 4 is a functional block diagram of the printer.

Referring to FIG. 4, the printer 10 comprises a controller 130. The controller 130 comprises a CPU 131, a ROM 132, a RAM 133, an EEPROM 134, and an ASIC 135, which are connected to each other by an internal bus 137. The ROM 132 stores programs for the CPU 131 to control various operations of the printer 10. The RAM 133 is used as a storage area for temporarily store date and signals for the CPU 131 to use in executing the programs and as a working area for date processing. The EEPROM 134 stores settings and flags which may be retained even after the power is off. One chip may comprise the CPU 131, the ROM 132, the RAM 133, the EEPROM 134, and the ASIC 135, or one chip may comprise some of the CPU 131, the ROM 132, the RAM 133, the EEPROM 134, and the ASIC 135, and another chip may comprise the other of the CPU 131, the ROM 132, the RAM 133, the EEPROM 134, and the ASIC 135.

The controller 130 is configured to rotate the paper feed roller 23, the conveying roller pair 25, and the discharge roller pair 27 by driving a motor (not shown). The controller 130 is configured to control the recording head 21 to eject ink from the nozzles 29. More specifically, the controller 130 is configured to send to the head control board 21A control signals indicating the values of driving voltages to be applied to the piezoelectric actuators 29A. The head control board 21A is configured to apply the driving voltages to the piezoelectric actuators 29A based on the control signals received from the controller 130, such that ink is ejected from the nozzles 29. The printer 10 also comprises a display 109, and the controller 130 is configured to control the display 109 to display information about the printer 10 and the ink cartridge 30 or a variety of messages.

The printer 10 also comprises a temperature sensor 106 and a cover sensor 108, and the controller 130 is configured to receive the detection signals output from the sensor 103, signals output from the temperature sensor 106, the detection signals output from the mount sensor 107, and signals output from the cover sensor 108. The temperature sensor 106 is configured to output signals based on temperature. Where the temperature sensor 106 senses temperature is not limited to a specific position. The temperature sensor 103 may be positioned in the cartridge mounting portion 110, or may be positioned on an outer surface of the printer 10. The cover sensor 108 is configured to output different signals based on whether the cover for the opening 112 of the cartridge mounting portion 110 is opened or closed.

Figure 5A:
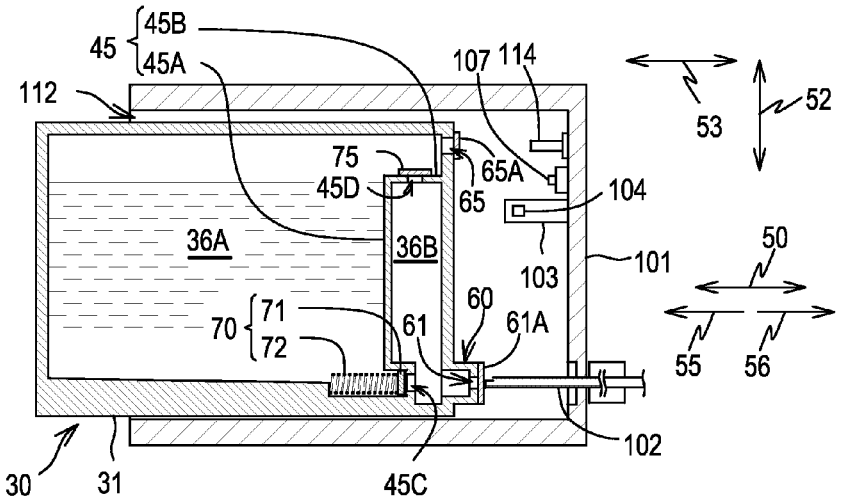
FIG. 5A is a cross-sectional view of the ink cartridge and the cartridge mounting portion during insertion of the ink cartridge into the cartridge mounting portion.

The ink cartridge 30 is inserted into the cartridge mounting portion 110 when the cover of the cartridge mounting portion 110 is opened. Referring to FIG. 5A, when the ink cartridge 30 is being inserted into the cartridge mounting portion 110, the ink supply opening 61 is closed by the film 61A and the communication opening 45C is closed by the movable member 71 positioned in the block position. The sensor 103 outputs the High-level signal to the controller 130, and the mount sensor 107 outputs the Low-level signal to the controller 130.

Figure 5B:
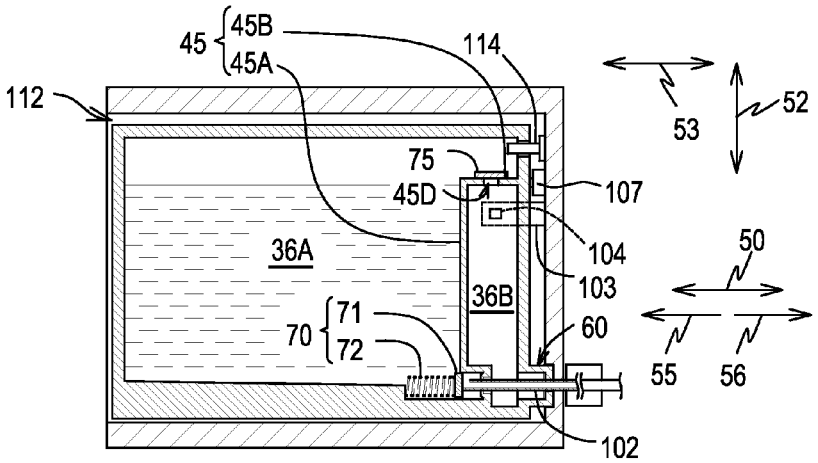
FIG. 5B is a cross-sectional view of the ink cartridge and the cartridge mounting portion when mounting of the ink cartridge to the cartridge mounting portion has been just completed.

Referring to FIG. 5B, when the ink cartridge 30 is further inserted into the cartridge mounting portion 110, the hollow tube 102 penetrates and ruptures the film 61A and enters the ink supply portion 60. The hollow tube 102 then passes through the communication opening 45C and pushes the movable member 71 in the removal direction 55 from the block position to the communication position against the biasing force of the coil spring 72. The rod 114 penetrates and ruptures the film 65A. When this occurs, ink flows out of the first ink chamber 36A into the hollow tube 102 via the opening formed at the distal-end side of the hollow tube 102. Moreover, ink flows out of the first ink chamber 36A into the second ink chamber 36B through the gap between the communication opening 45C and the hollow tube 102. Air comes into the first ink chamber 36A and the second ink chamber 36B via the air communication opening 65 and the opening 45D.

Figure 5C:
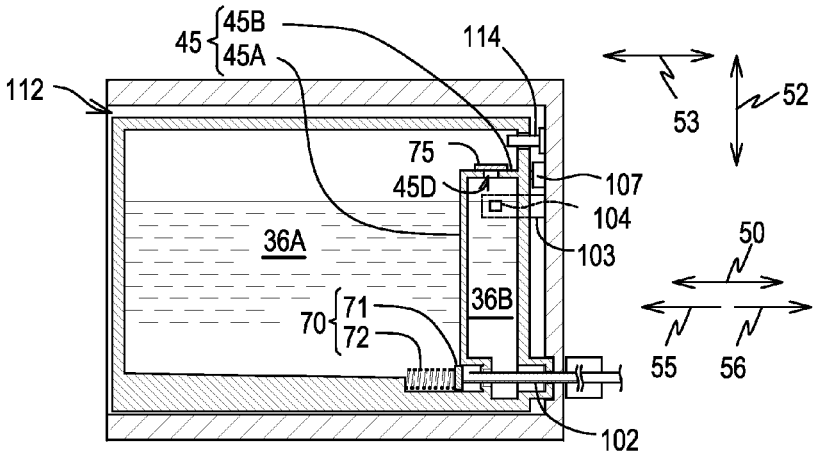
FIG. 5C is a cross-sectional view of the ink cartridge and the cartridge mounting portion when mounting of the ink cartridge to the cartridge mounting portion has been completed and the ink surface of a second ink chamber reaches a detection position.

When the mounting of the ink cartridge 30 to the cartridge mounting portion 110 is completed, the front wall 40 of the ink cartridge 30 pushes the mount sensor 107. When this occurs, the mount sensor 107 outputs the High-level signal to the controller 130. Although ink has started to flow into the second ink chamber 36B from the first ink chamber 36A, the ink surface in the second ink chamber 36B has not reached the height of the sensor 103, i.e., has not reached the detection position at a time immediately after the mounting of the ink cartridge 30 to the cartridge mounting portion 110 is completed. Therefore, in the state depicted in FIG. 5B, the sensor 103 outputs the High-level signal to the controller 130. The ink surface in the first ink chamber 36A moves down and the ink surface in the second ink chamber 36B moves up as ink moves from the first ink chamber 36A to the second ink chamber 36B. Referring to FIG. 5C, when the ink surface in the second ink chamber 36B reaches the detection position, the sensor 103 outputs the Low-level signal to the controller 130. In other words, the sensor 103 outputs the detection signal based on an amount of ink which has flowed from the first ink chamber 36A to the second ink chamber 36B. Finally the height of the ink surface in the first ink chamber 36A and the height of the ink surface in the second ink chamber 36B becomes the same.

When a user thinks that the mounting of the ink cartridge 30 to the cartridge mounting portion 110 has been completed, the user closes the cover of the cartridge mounting portion 110 to cover the opening 112. Even if the mounting of the ink cartridge 30 to the cartridge mounting portion 110 has not been completed, the closed cover contacts and pushes the ink cartridge 30 in the insertion direction 56 to complete the mounting of the ink cartridge 30 to the cartridge mounting portion 110.

[Processes Performed by the Controller 130]

Figure 6:
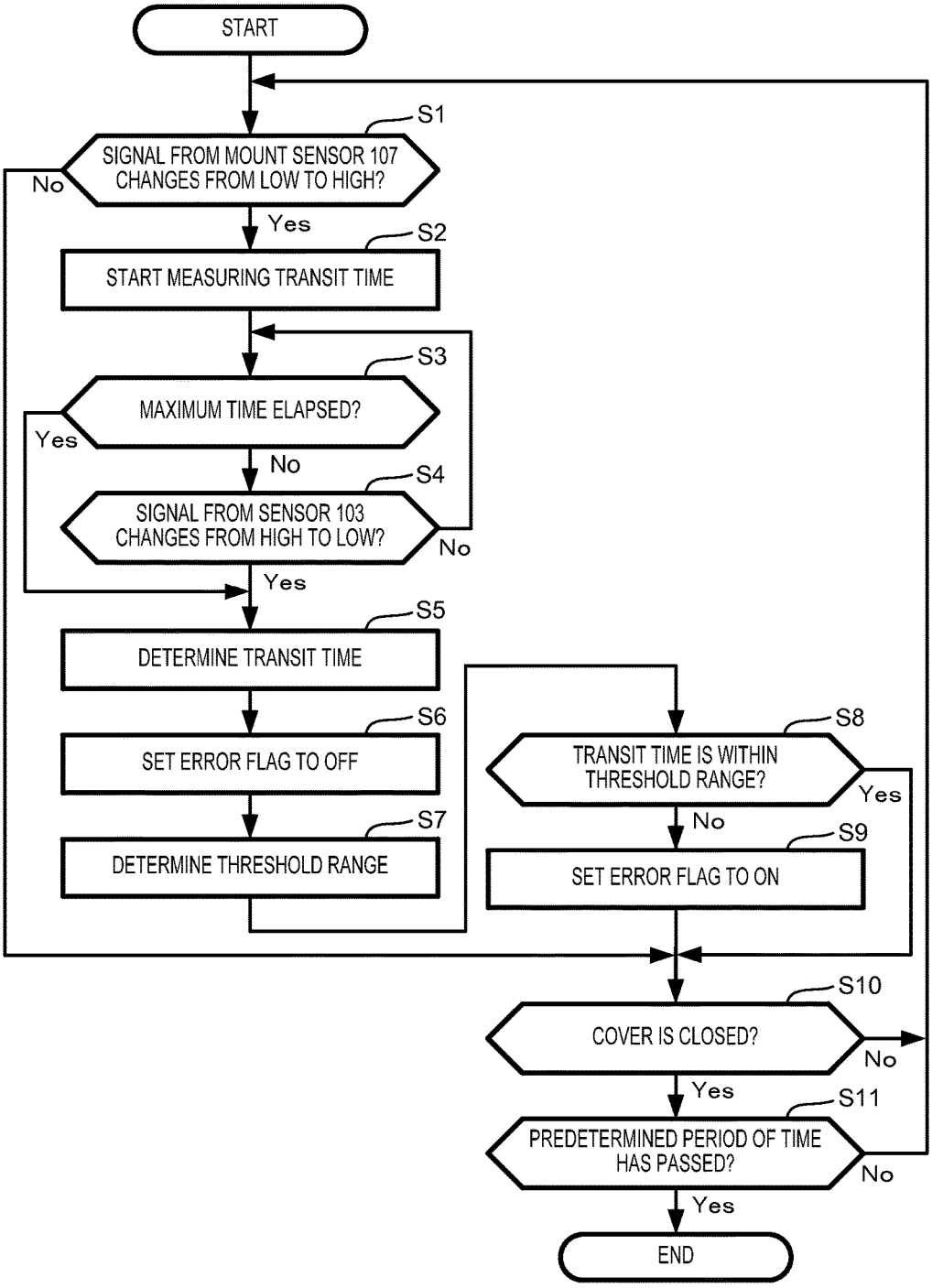
FIG. 6 is a flow chart of processes performed by a controller when a cover of the cartridge mounting portion is opened and a mount sensor outputs a Low-level signal.

The controller 130 is configured to perform the processes of FIG. 6 when the controller 130 receives the signal from the cover sensor 108 indicating that the cover of the cartridge mounting portion 110 is opened and receives the Low-level signal from the mount sensor 107. In other words, the processes of FIG. 6 start when the cover of the cartridge mounting portion 110 is opened and the ink cartridge 30 is removed.

The controller 130 starts measuring a transit time at step S2 if the detection signal output from the mount sensor 107 changes from the Low-level signal to the High-level signal (step S1: Yes). If the detection signal output from the mount sensor 107 does not change from the Low-level signal to the High-level signal (step S1: No), the controller 130 performs the process of step S10 (described later). For instance, the situation in which the detection signal output from the mount sensor 107 does not change from the Low-level signal to the High-level signal (step S1: No) corresponds to a situation in which a new ink cartridge 30 has not been mounted to the cartridge mounting portion 110.

Subsequently, the controller 130 determines whether the elapsed time since the controller 130 starts measuring the transit time has exceeded a predetermined maximum time at step S3. If the elapsed time has exceeded the maximum time (step S3: Yes), the controller 130 performs the process of step S5 (described later). If the elapsed time has not exceeded the maximum time (step S3: No), the controller 130 determines whether the detection signal output from the sensor 103 changes from the High-level signal to the Low-level signal at step S4. If the detection signal output from the sensor 103 does not change from the High-level signal to the Low-level signal (step S4: No), the controller 103 performs the process of step S3 again. If the detection signal output from the sensor 103 changes from the High-level signal to the Low-level signal (step S4: Yes), the controller 103 determines the transit time at step S5.

The transit time is a period of time from when the detection signal output from the mount sensor 107 changes from the Low-level signal to the High-level signal (step S1: Yes) to when the detection signal output from the sensor 103 changes from the High-level signal to the Low-level signal (step S4: Yes). In other words, the transit time is a time required for the ink surface in the second ink chamber 36B to move between two points. In this embodiment, the transit time is a time required for the ink surface in the second ink chamber 46B to move from the zero height point to the point corresponding to the detection position. In other words, the controller 130 measures the transit time from when the High-level signal is output from the mount sensor 107 to when the Low-level signal is output from the sensor 103. If the elapsed time has exceeded the maximum time (step S3: Yes), the controller 130 considers the maximum time as the transit time.

The situation in which the elapsed time has exceeded the maximum time (step S3: Yes) corresponds to a situation in which ink flows very slowly from the first ink chamber 36A to the second ink chamber 36B via the communication opening 45C or does not flow from the first ink chamber 36A to the second ink chamber 36B. A reason for the slow movement of ink may be that the viscosity of ink stored in the ink chamber 36 has become high.

The timing when the communication opening 45C is opened such that the first ink chamber 36A and the second ink chamber 36B are brought into fluid communication via the communication opening 45C and the timing when the output signal from the mount sensor 107 changes from the Low-level signal to the High-level signal are the same or close. Therefore, the latter timing is presumed as the former timing. The controller 130 measures, as the transit time, a time required for the ink surface in the second ink chamber 36B to move from when the detection signal output from the mount sensor 107 changes from the Low-level signal to the High-level signal to when the ink surface reaches the detection position. This transit time is presumed as the time required for the ink surface in the second ink chamber 46B to move from the zero height point to the point corresponding to the detection position.

Subsequently, the controller 130 resets an error flag, i.e., sets the error flag to "OFF" at step S6. The error flag is set to "ON" when the transit time is not within a threshold range (step S8: No). The error flag is set for each ink cartridge 30. The controller 130 stores the error flag in the EEPROM 134.

Subsequently, the controller 130 determines the threshold range based on the signal output from the temperature sensor 106 at step S7. The threshold range is compared with the transit time for estimating the viscosity of ink stored in the ink chamber 36. If the signal output from the temperature sensor 106 indicates that the temperature is relatively high, the controller 130 sets at least one of the upper limit value and the lower limit value of the threshold range lower. In other words, if the signal output from the temperature sensor 106 indicates that the temperature is relatively low, the controller 130 sets at least one of the upper limit value and the lower limit value of the threshold range higher.

Subsequently, the controller 130 compares the transit time determined at step S5 with the threshold range determined at step S7 and determines whether or not the transit time is within the threshold range at step S8. If the transit time is below the lower limit value, it is estimated that the viscosity of ink is too low. If the transit time is above the upper limit value, it is estimated that the viscosity of ink is too high. If the transit time is out of the threshold range (step S8: No), the controller 130 sets the error flag to "ON" at step S9. If the transit time is within the threshold range (step S8: Yes), the controller 130 skips the process of step S9.

Subsequently, the controller 130 determines whether or not the cover sensor 108 outputs the signal indicating that the cover of the cartridge mounting portion 110 is closed at step S10. If it is determined that the cover is open (step S10: No), the controller 130 repeats the process of step S1 and the processes that follow step S1. If it is determined that the cover is closed (step S10: Yes), the controller 130 determines at step S11 whether or not a predetermined period of time has passed since it is determined that the cover is closed at step S10.

If the predetermined period of time has passed (step S11: Yes), the controller 130 complete the processes of FIG. 6. If the predetermined period of time has not passed (step S11: No), the controller 130 repeats the process of step S1 and the processes that follow step S1. If the controller 130 determines that the cover of the cartridge mounting portion 110 is open (step S10: No) when the controller 130 is repeating the process of step S1 and the processes that follow step S1, the controller 130 cancels the counting of time it started when it determined that the cover was closed (step S10: Yes).

Figure 7:
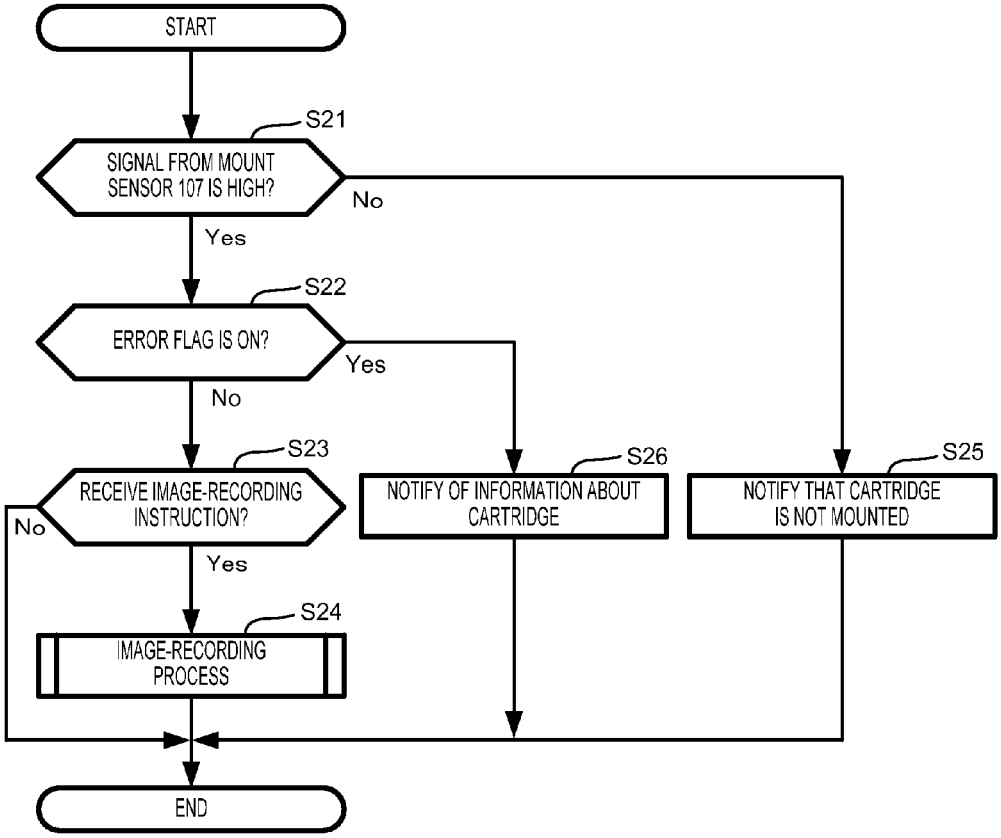
FIG. 7 is a flow chart of processes performed by the controller when the processes of FIG. 6 have been completed and the cover of the cartridge mounting portion is closed.

After completing the processes of FIG. 6, the controller 130 performs the processes of FIG. 7 repeatedly at a predetermined interval when the controller 130 receives from the cover sensor 108 the signal indicating that the cover of the cartridge mounting portion 110 is closed.

The controller 130 determines whether the mount sensor 107 outputs the High-level signal at step S21. If the mount sensor 107 outputs the Low-level signal (step S21: No), the controller 130 notifies a user that the ink cartridge 30 is not mounted at step S25, and completes the processes of FIG. 7. How to notify a user is not limited to a specific way, but the controller 130 may have the display 109 display a message or have a speaker (not shown) of the printer 10 sound out an audio message.

If the mount sensor 107 outputs the High-level signal (step S21: Yes), the controller 130 determines whether the error flag is set to "ON" at step S22. If the error flag is set to "ON" (step S22: Yes), the controller 130 performs the process of step S26. The controller 130 notifies a user of information about the ink cartridge 30 at step S26, and then completes the process of FIG. 7. The controller 130 may notify a user that ink in the ink chamber 36 has deteriorated, or that the replacement of the ink cartridge 30 is needed. How to notify a user is not limited to a specific way, but the controller 130 may have the display 109 display a message or have a speaker (not shown) of the printer 10 sound out an audio message.

If the error flag is set to "OFF" (step S22: No), the controller 130 determines whether it receives an image-recording instruction at step S23. If the controller 130 does not receive the image-recording instruction (step S23: No), the controller 130 completes the processes of FIG. 7. If the controller 130 receives the image-recording instruction (step S23: Yes), the controller 130 directly or indirectly controls the recording head 21, the paper feed roller 23, the conveying roller pair 25, the discharge roller pair 27, etc. to record an image of a sheet of recording paper at step S24, and then complete the processes of FIG. 7. The controller 130 may record an image on one sheet of recording paper when performing the process of step S24 once, or the controller 130 may record images corresponding to all the image date that the controller 130 received when performing the process of step S24 once.

If the error flag is set to "ON" (step S22: Yes), the controller 130 does not perform the process of step S24, i.e., the image-recording process. In other words, the controller 130 skips step S24 and thereby restricts the consumption of ink by the recording head 21.

According to the processes of FIG. 6, if an ink cartridge 30 having a sufficient amount of ink stored therein is removed from the cartridge mounting portion 110, and then is mounted to the cartridge mounting portion 110 again, the error flag is set to "ON." This is because ink no longer moves from the first ink chamber 36A to the second ink chamber 36B when the ink cartridge 30 is mounted to the cartridge mounting portion 110 again. In this situation, the image-recording process of step S24 is skipped even if the ink cartridge 30 has a sufficient amount of ink. Therefore, in another embodiment, the controller 130 may ask a user if he or she has replaced the ink cartridge 30 after step S22. How to ask a user is not limited to a specific way, but the controller 130 may have the display 109 display a message or have a speaker (not shown) sound out an audio message. The controller 130 then may wait for a signal to come from an input interface (not shown) of the printer 10. For instance, the input interface is an interface on which a user may give instructions to the printer 10 by pressing bottoms on it. If the controller 130 receives from the input interface a signal indicating that the ink cartridge 30 has not been replaced, the controller 130 may not perform the process of step S26 and perform the process of step S24. In such a case, the processes performed by the controller 130 may be different from the ones of FIGS. 6 and 7, but the description thereof is omitted here.

[Advantages]

According to the above-described embodiment, the flow rate of ink moving from the first ink chamber 36A to the second ink chamber 36B varies depending on the viscosity of ink. By measuring the transit time required for the ink surface in the second ink chamber 36B to move from when the communication opening 45C is opened to when the ink surface reaches the detection position, the viscosity of ink in the ink chamber 36 can be estimated, e.g. whether the viscosity of ink is within a certain range or not can be estimated.

That is, the amount (volume) of ink stored in the second ink chamber 36B during when the ink surface in the second ink chamber 36B moves between the two points is constant. (As described above, the two points are the zero height point and the point corresponding to the detection position.) Therefore, the flow rate of ink, i.e., an amount (volume) of ink that passes through the communication opening 45C can be specified by by measuring the transit time for the ink surface in the second ink chamber 36B to move between the two points. Therefore, the degree of deterioration of ink can be estimated by calculating the transit time even when the ink cartridge 30 has not been mounted to the printer 10 and been unused for a long time. Moreover, if a plurality of ink cartridges 30 storing inks having different viscosities are configured to be mounted to the same cartridge mounting portion 110, it is possible to determine which ink cartridge 30 is mounted by calculating the transit time.

In the above-described embodiment, the ink surface in the second ink chamber 36B is detected by the sensor 103. In another embodiment, the ink surface in the first ink chamber 36A may be detected by the sensor 103. In such a case, the sensor 103 is positioned below the first initial ink surface of the first initial amount of ink in the first ink chamber 36A before the communication opening 45C is opened. The controller 130 measures, as the transit time, a time from when the detection signal from the mount sensor 107 changes from the Low-level signal to the High-level signal to when the detection signal from the sensor 103 changes from the Low-level signal to the High-level signal.

In the above-described embodiment, the controller 130 starts measuring the transit time at a timing when the mounting of the ink cartridge 30 to the cartridge mounting portion 110 is completed, i.e., the detection signal from the mount sensor 107 changes from the Low-level signal to the High-level signal. Nevertheless, the timing when the controller 130 starts measuring the transit time is not limited thereto, and can be any timing. For instance, the timing can be a certain timing after the mounting of the ink cartridge 30 to the cartridge mounting portion 110 is completed or a certain timing just before the mounting of the ink cartridge 30 to the cartridge mounting portion 110 is completed.

In the above-described embodiment, the time from when the communication opening 45C is opened to when the ink surface reaches the detection position is measured as the transit time. Nevertheless, the transit time is not limited thereto. For instance, the cartridge mounting portion 110 may comprise a first optical sensor and a second optical sensor positioned away from each other in the height direction 52, and the first and second optical sensors face the second ink chamber 36B of the ink cartridge 30 mounted to the cartridge mounting portion 110. The controller 130 may measure, as the transit time, a time from when the ink surface in the second ink chamber 36B reaches the first optical sensor to when the ink surface reaches the second optical sensor. In other words, the transit time is a time required for the ink surface in the second ink chamber 36B to move between two points.

The transit time is an example of a physical quantity, based on which the flow rate of ink can be specified. Nevertheless, the example of the physical quantity is not limited to the transit time. For instance, a rotator may be disposed in the first ink chamber 36A or the second ink chamber 36B. The rotator is configured to rotate according to the movement of ink from the first ink chamber 36A to the second ink chamber 36B. The cartridge mounting portion 110 may comprise a detector configured to detect the rotation of the rotator. The controller 130 may measure, as the transit time, the number of rotations of the rotator within a predetermined time, or measure a time required for the rotator to rotate predetermined times.

In the above-described embodiment, with the air communication opening 65 and the communication opening 45C, the pressure in the first ink chamber 36A and the pressure in the second ink chamber 36B becomes the same, i.e., becomes the atmospheric pressure. Therefore, the flow rate of ink moving from the first ink chamber 36A to the second ink chamber 36B is not influenced by a pressure differential between the pressure in the first ink chamber 36A and the pressure in the second ink chamber 36B. How to bring the first ink chamber 36A and the second ink chamber 36B into communication with the atmosphere is not limited to the way described in the above-described embodiment. Moreover, the first ink chamber 36A and the second ink chamber 36B are not necessarily needed to be brought into communication with the atmosphere.

According to the above-described embodiment, when the transit time is out of the threshold range (step S8: No), the controller 130 restricts the performance of the recording head 29, i.e., skips step S24. Therefore, a trouble of the recording head 21 which may be caused by an unusual viscosity of ink can be prevented. Nevertheless, it is not always necessary to skip step S24. In another embodiment, if the error flag is "ON" (step S22: Yes), the process of step S26 notifying a user of the information about the ink cartridge 30 may be performed, but the controller 130 may let the user decide whether image recording should be performed. In such a case, the processes performed by the controller 130 may be different from the ones of FIGS. 6 and 7, but the description thereof is omitted here.

Moreover, in another embodiment, if the error flag is "ON" (step S22: Yes), steps S23 and S24 may not be skipped, but the controller 130 may control the head control board 21A, such that the driving voltages applied to the piezoelectric actuators 29A are adjusted at step S24. More specifically, the controller 130 outputs different control signals to the heard control board 21A, such that the driving voltages applied to the piezoelectric actuators 29A are adjusted for the amounts of ink ejected from the nozzles 29 to be the same amount between when the transit time is within the threshold range and when the transit time is out of the threshold range. That is, when the transit time is below the lower limit value of the threshold range (it is estimated that the viscosity of ink is too low), the driving voltages are made smaller than the driving voltages when the transit time is within the threshold range. When the transit time is above the upper limit value of the threshold range (it is estimated that the viscosity of ink is too high), the driving voltages are made larger than the driving voltages when the transit time is within the threshold range. In this case, if a plurality of ink cartridges 30 storing inks having different viscosities is configured to be mounted to the same cartridge mounting portion 110, it is possible to drive the piezoelectric actuators 29A with suitable voltages according to types of ink. The actuators may not be limited to the piezoelectric actuators 29A, but may be thermal-type actuators, which ejects ink from the nozzles 29 by applying heat to ink and thereby generating bubbles in ink.

In addition to controlling the head control board 21A, such that the driving voltages applied to the piezoelectric actuators 29A are adjusted, the controller 130 may control a purge operation, in which ink is forcedly discharged from the nozzles 29 of the recording head 21. For instance, if the controller 130 determines that the error flag is set to "ON" (step S22: Yes), the controller 130 may control the purge operation, such that ink is discharged with more pressure applied thereto than if the controller 130 determines that the error flag is set to "OFF" (step S22: No). More specifically, when ink is discharged from the nozzles 29 of the recording head 21 by a suction pump, the controller 130 may control the suction pump, such that the suction pump sucks ink with more suction pressure if the error flag is set to "ON." With this control, air bubbles or thickened ink in the recording head 21 can be reliably discharged by the purge operation even if the viscosity of ink is high, and ink can be reliably supplied from the ink tube 20 to the recording head 21.

In the above-described embodiment, both of the upper limit value and the lower limit value of the threshold range are specified. Nevertheless, in another embodiment, at least one of the upper limit value and the lower limit value of the threshold range is specified.

The viscosity of ink changes when the surrounding temperature changes. When the temperature is high, the viscosity is low. When the temperature is low, the viscosity is high. The controller 130 may control the head control board 21A, such that the driving voltages applied to the piezoelectric actuators 29A are adjusted based on the temperature. More specifically, when the temperature is high, the controller 130 outputs control signals to the head control board 21A, such that low driving voltages are applied to the piezoelectric actuators 29A. When the temperature is low, the controller 130 outputs control signals to the head control board 21A, such that high driving voltages are applied to the piezoelectric actuators 29A. There is an optimum threshold range of the viscosity of ink, corresponding to the driving voltages applied to the piezoelectric actuators 29A which are determined by the temperature. In other word, it is preferable to set the threshold range of the viscosity of ink based on the temperature. Therefore, according to the above-described embodiment, the controller 130 determines the threshold range based on the temperature at step S7. How to determine the threshold range is not limited to a specific way, but the controller 130 may select one suitable threshold range based on the temperature out of a plurality of threshold ranges stored in the ROM 132, or may calculate the upper limit value or the lower limit value of the threshold range as a function of the temperature value. Nevertheless, step S7 for determining the threshold range based on the temperature may be removed, and a fixed threshold range can be used at step S8, when, for example, the driving voltages applied to the piezoelectric actuators 29A are not adjusted based on the temperature.

How to open and close the communication opening 45C, the ink supply opening 61, and air communication opening 65 is not limited to the way described in the above-described embodiment. For instance, the communication opening 65 may be closed by a rupturable wall, and the hollow tube 102 may penetrate and rupture the rupturable wall, such that the first ink chamber 36A and the second ink chamber 36B are brought into fluid communication. Each of the ink supply opening 61 and the air communication opening 65 may be closed by a valve mechanism like the valve mechanism 70. The air communication opening 65 may be closed by an air permeable film, such that the ink chamber 36 is brought into communication with the atmosphere before the ink cartridge 30 is mounted to the cartridge mounting portion 110.

According to the above-described embodiment, the controller 130 stores the error flag in the EEPROM 134, but the controller 130 may store the error flag in a memory of an IC chip (not shown) mounted on the ink cartridge 30. According to the above-described embodiment, the controller 130 comprises the CPU 131 and the ASIC 135, but the controller 130 may not comprise the ASIC 135 and the CPU 131 may perform all the processes of FIGS. 6 and 7 by reading out a program stored in the ROM 132. On the contrary, the controller 130 may not comprise the CPU 131, and may comprise hardware only, such as the ASIC 135 or FPGA. Moreover, the controller 130 may comprise a plurality of CPUs 131 and/or a plurality of ASICs 135.

Referring to FIGS. 8A to 17B, first to seventh modified embodiments are described. The descriptions of the parts which are common between the above-described embodiment and the first to seventh embodiments may be omitted, but the parts which are different from the parts of the other embodiments are described. Moreover, the parts of the above-described embodiment and the first to seventh modified embodiments can be arbitrarily combined as long as the object of the invention is achieved.

<First Modified Embodiment>

Figure 8A:
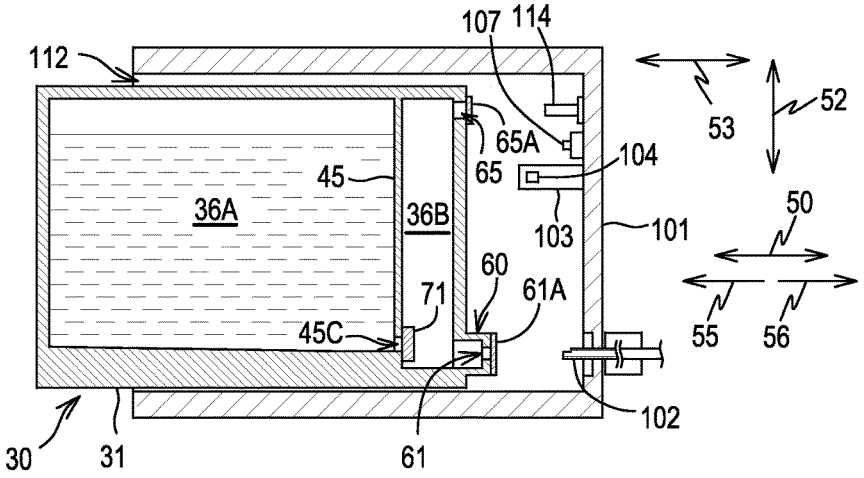
FIG. 8A is a cross-sectional view of an ink cartridge and a cartridge mounting portion according to a first modified embodiment during insertion of the ink cartridge into the cartridge mounting portion.
Figure 8B:
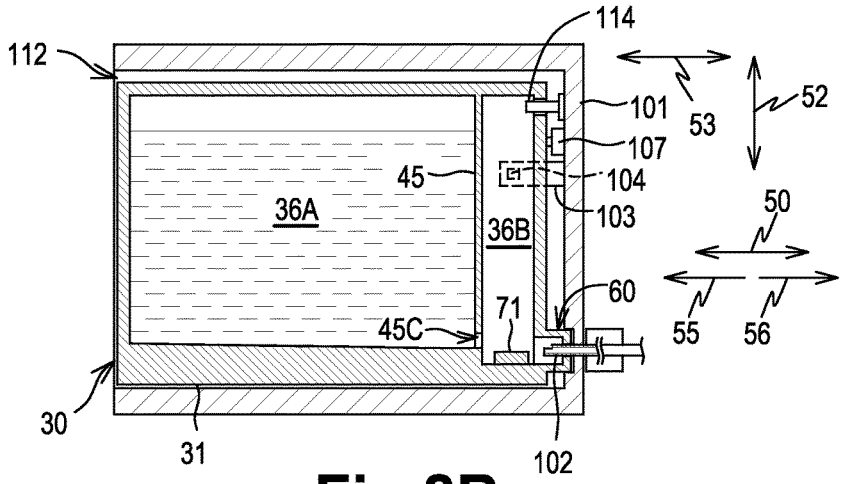
FIG. 8B is a cross-sectional view of the ink cartridge and the cartridge mounting portion according to the first modified embodiment when mounting of the ink cartridge to the cartridge mounting portion has been just completed.
Figure 8C:
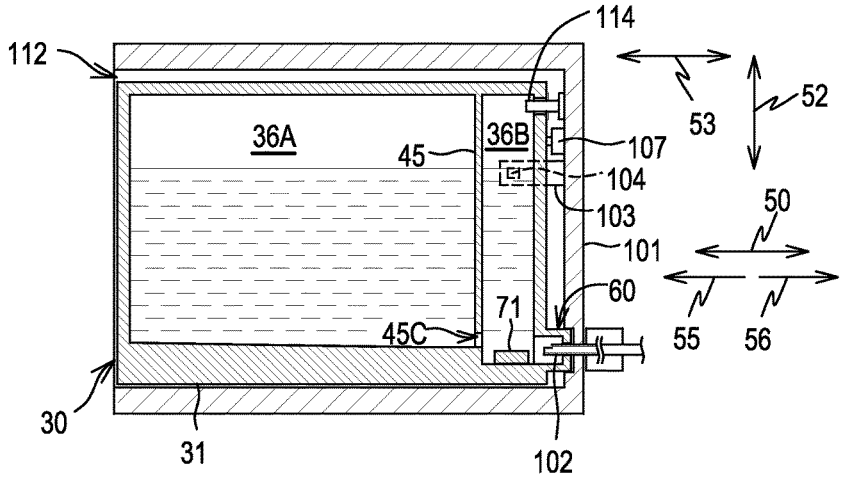
FIG. 8C is a cross-sectional view of the ink cartridge and the cartridge mounting portion according to the first modified embodiment when mounting of the ink cartridge to the cartridge mounting portion has been completed and the ink surface of a second ink chamber reaches a detection position.

Referring to FIG. 8A to 8C, an ink cartridge 30 and a cartridge mounting portion 110 according to the first modified embodiment are described. The partitioning wall 45 of the ink cartridge 30 according to this first modified embodiment extends substantially in parallel with the front wall 40 and the rear wall 41 and is connected to the top wall 39 and the bottom wall 42. The air communication opening 65 of the ink cartridge 30 according to this first modified embodiment is configured to bring the second ink chamber 36B into fluid communication with the atmosphere outside the ink cartridge 30. The movable member 71 of the ink cartridge 30 according to this first modified embodiment is positioned in the second ink chamber 36B and closes the communication opening 45C from the second-ink-chamber 36B side. Before the ink cartridge 30 is mounted to the cartridge mounting portion 110, the pressure in the first ink chamber 36A is maintained at a first pressure which is greater than the atmospheric pressure and the pressure in the second ink chamber 36B is maintained at a second pressure which is greater than the first pressure.

Referring to FIG. 8A, the movable member 71 contacts a portion of the partitioning wall 45 surrounding the communication opening 45C due to the pressure differential between the pressure in the first ink chamber 36A and the second ink chamber 36B, and thereby closes the communication opening 45C. In other words, the movable member 71 is in the block position. Referring to FIG. 8B, when the rod 114 penetrates and ruptures the film 65A and thereby the air communication opening 65 is opened, the first ink chamber 36A and the second ink chamber 36B are brought into communication with the atmosphere via the air communication opening 65 and opening 45C. As a result, the pressure differential between the pressure in the first ink chamber 36A and the second ink chamber 36B becomes zero, and the movable member 71 moves away from the partitioning wall 45 to open the communication opening 45C. In other words, the movable member 71 moves to the communication position. Ink flows from the first ink chamber 36A to the second ink chamber 36B via the communication opening 45C. Referring to FIG. 8C, when the ink surface in the second ink chamber 36B reaches the detection position, the sensor 103 outputs the Low-level signal to the controller 130. A portion of ink in the second ink chamber 36B flows into the ink tube 20 via the hollow tube 102.

According to this first modified embodiment, the communication opening 45C formed through the partitioning wall 45 is opened and closed by the pressure differential between the pressure in the first ink chamber 36A and the pressure in the second ink chamber 36B. Therefore, the number of parts of the ink cartridge 30 can be reduced. In another embodiment, before the ink cartridge 30 is mounted to the cartridge mounting portion 110, the pressure m the first ink chamber 36A may be greater than the pressure in the second ink chamber 36B, and the movable member 71 may be positioned in the first ink chamber 36A and close the communication opening 45C from the first-ink-chamber 36A side.

<Second Modified Embodiment>

Figure 9:
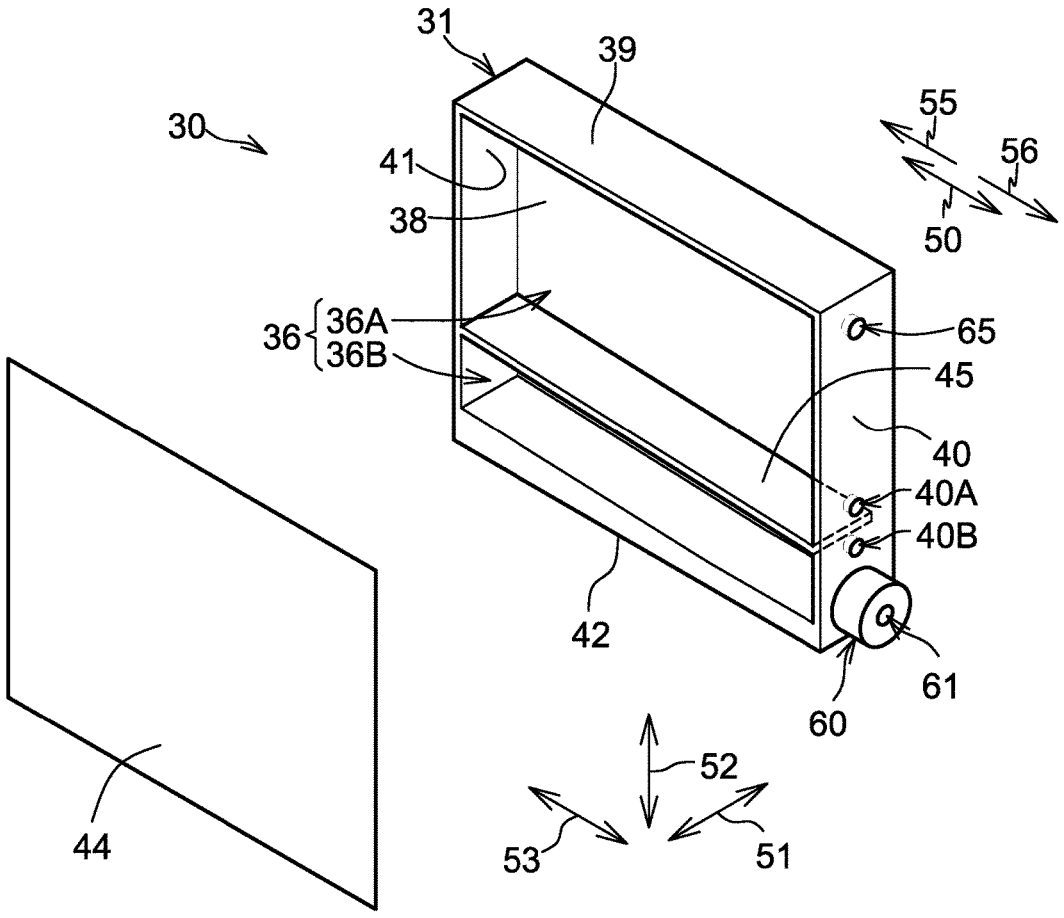
FIG. 9 is an exploded perspective view of an ink cartridge according to a second modified embodiment.

Referring to FIGS. 9 to 11C, an ink cartridge 30 and a cartridge mounting portion 110 according to the second modified embodiment are described. Referring to FIG. 9, the partitioning wall 45 extends substantially in parallel with the top wall 39 and the bottom wall 42 and is connected to the front wall 40 and the rear wall 41. The partitioning wall 45 partitions the ink chamber 36 into the first ink chamber 36A and the second ink chamber 36B with respect to the height direction 52. The first ink chamber 36A and the second ink chamber 36B are aligned in the height direction 52 sandwiching the partitioning wall 45 therebetween. The second ink chamber 36B is positioned farther from the top wall 39 than the first ink chamber 36A is. Before the ink cartridge 30 is mounted to the cartridge mounting portion 110, the first ink chamber 36A stores a first initial amount of ink therein and the second ink chamber 36B stores a second initial amount of ink therein. In this second modified embodiment, the second initial amount of ink is zero, i.e., the second ink chamber 36B does not store ink therein. The ink supply portion 60 is provided at the front wall 40 at a position aligned with the second ink chamber 36B in the depth direction 53. The air communication opening 65 is provided at the front wall 40 at a position aligned with the first ink chamber 36A in the depth direction 53.

Figure 11A:
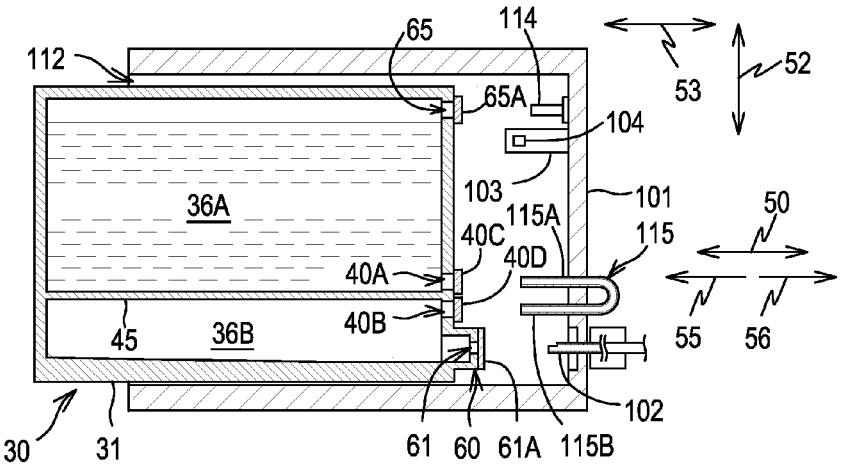
FIG. 11A is a cross-sectional view of the ink cartridge and the cartridge mounting portion according to the second modified embodiment during insertion of the ink cartridge into the cartridge mounting portion.

Referring to FIG. 9, the front wall 40 of the ink cartridge 30 according to this second modified embodiment has a first opening 40A and a second opening 40B formed therethrough in the depth direction 53. The first opening 40A is aligned with the first ink chamber 36A in the insertion direction 56 and therefore the first opening 40A can bring the first ink chamber 40A into fluid communication with the outside of the ink cartridge 30. The second opening 40B is aligned with the second ink chamber 36B in the insertion direction 56 and therefore the second opening 40B can bring the second ink chamber 36B into fluid communication with the outside of the ink chamber 30. Referring to FIG. 11A, the first opening 40A is closed by a rupturable wall, e.g., a film 40C, and second opening 40B is closed by a rupturable wall, e.g., a film 40D.

Figure 10:
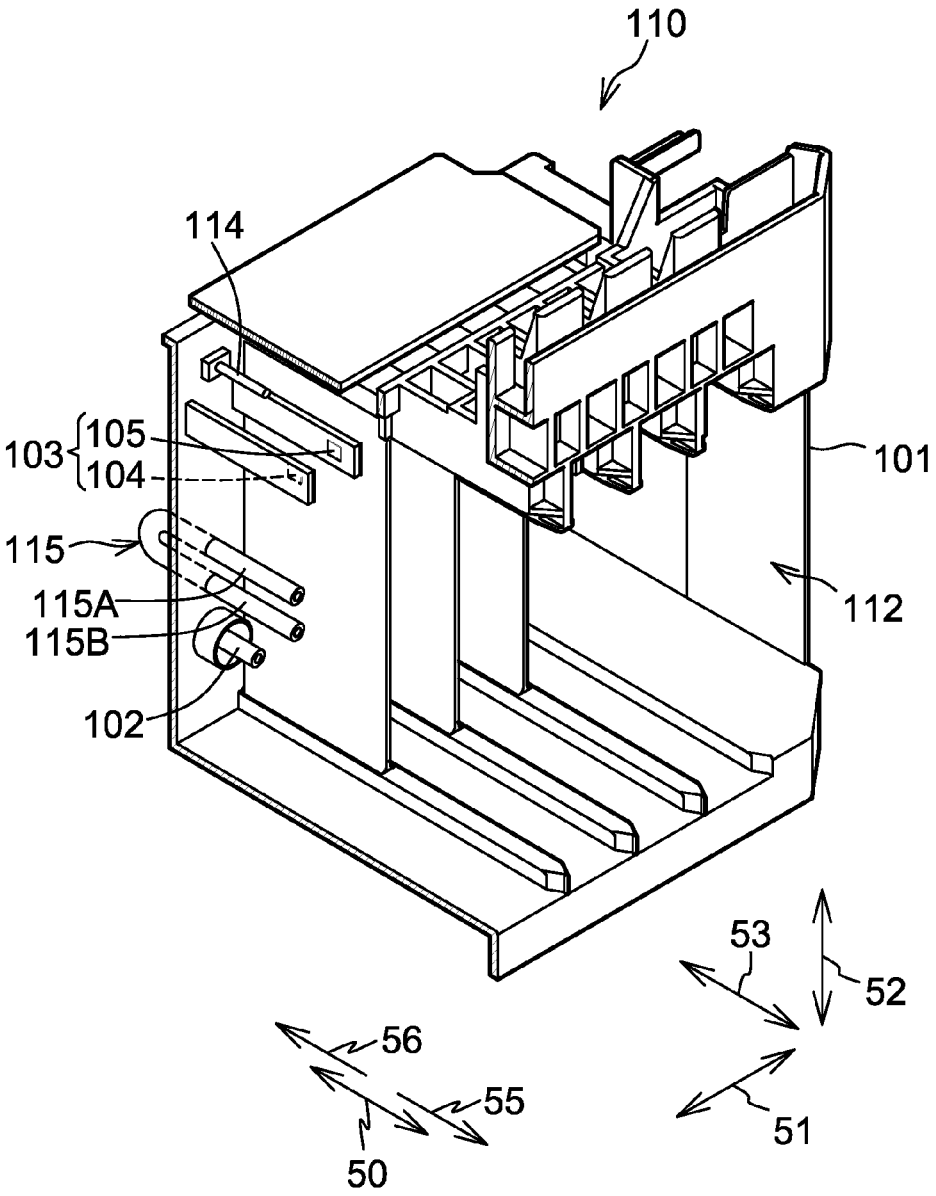
FIG. 10 is a perspective view of a cartridge mounting portion which is partly cut, showing an end surface of the cartridge mounting portion according to the second modified embodiment.

Referring to FIG. 10, the cartridge mounting portion 110 according to this second modified embodiment comprises a hollow tube 115. The hollow tube 115 is provided at the end surface of the case 101 above the hollow tube 102. The hollow tube 115 has a U-shape having a first end 115A and a second end 115B. The first end 115A extends from the end surface of the case 101 in the removal direction 55 at a position corresponding to the first opening 40A of the ink cartridge 30. The second end 115B extends from the end surface of the case 101 in the removal direction 55 at a position corresponding to the second opening 40B of the ink cartridge 30. The inner space of the hollow tube 115 is open to the outside at the first end 115A and the second end 115B.

Figure 11B:
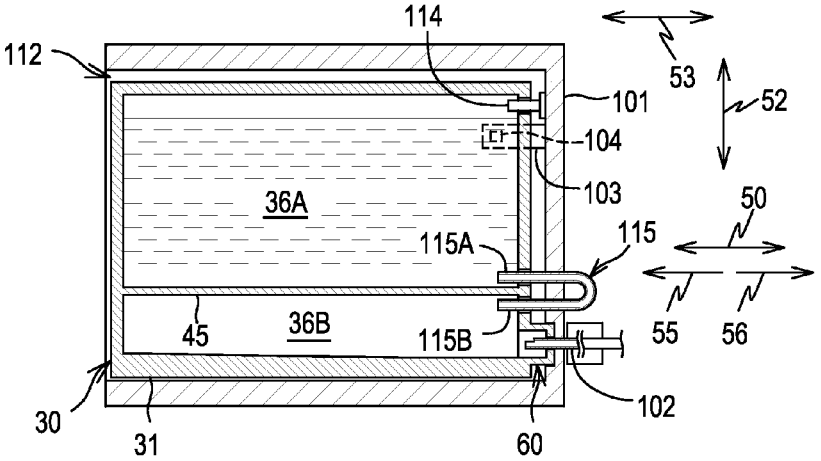
FIG. 11B is a cross-sectional view of the ink cartridge and the cartridge mounting portion according to the second modified embodiment when mounting of the ink cartridge to the cartridge mounting portion has been just completed.

Referring to FIG. 11B, when the ink cartridge 30 is mounted to the cartridge mounting portion 110, the first end 115A penetrates and ruptures the film 40C and then enters the first ink chamber 36A through the first opening 40A. The film 40C has elasticity, e.g., may be a rubber film. When the first end 115A is inserted through the film 40C, the film 40C tightly contacts the outer surface of the first end 115A. Similarly, when the ink cartridge 30 is mounted to the cartridge mounting portion 110, the second end 115B penetrates and ruptures the film 40D and then enters the second ink chamber 36B through the second opening 40B. The film 40D has elasticity, e.g., may be a rubber film. When the second end 115B is inserted through the film 40D, the film 40D tightly contacts the outer surface of the second end 115B. As a result, the first ink chamber 36A and the second ink chamber 36B are brought into fluid communication with each other via the hollow tube 115. Ink stored in the first ink chamber 36A flows into the second ink chamber 36B via the hollow tube 115, and ink flows out of the second ink chamber 36B into the hollow tube 102 via the ink supply portion 60. When the hollow tube 115 is removed from the film 40C and 40D, openings in the film 40C and 40D which are formed by the penetration of the hollow tube 115 can be closed by the elasticity of the film 40C and 40D.

Figure 11C:
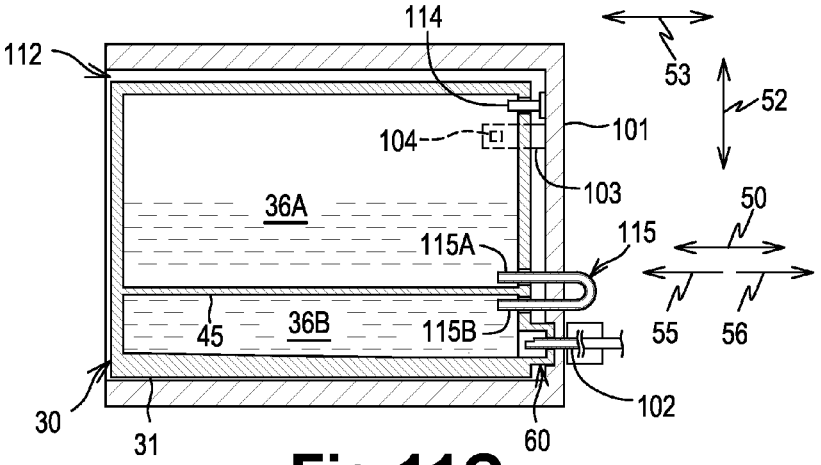
FIG. 11C is a cross-sectional view of the ink cartridge and the cartridge mounting portion according to the second modified embodiment when mounting of the ink cartridge to the cartridge mounting portion has been completed and the ink surface of a first ink chamber falls below a detection position.

The sensor 103 of the cartridge mounting portion 110 according to this second modified embodiment is positioned to face the first ink chamber 36A of the ink cartridge 30 mounted to the cartridge mounting portion 110. More specifically, referring to FIGS. 11A and 11B, the sensor 103 is positioned below the first initial ink surface in the first ink chamber 36A before the first ink chamber 36A is brought into fluid communication with the second ink chamber 36B. Referring to FIG. 11C, the sensor 103 is positioned above the ink surface in the first ink chamber 36A when the second ink chamber 36B is filled with ink.

When the ink cartridge 30 is mounted to the cartridge mounting portion 110 and the sensor 103 faces the first ink chamber 36A, the detection signal output from the sensor 103 changes from the High-level signal to the Low-level signal. Subsequently, when the ink surface in the first ink chamber 36A falls below the detection position, the detection signal output from the sensor 103 changes from the Low-level signal to the High level signal. The controller 130 measures, as the transit time, a time from when the detection signal output from the sensor 103 changes from the High-level signal to the Low-level signal to when the detection signal output from the sensor 103 changes from the Low-level signal to the High-level signal.

The timing when the first ink chamber 36A and the second ink chamber 36B are brought into fluid communication with each other via the hollow tube 115 and the timing when the detection signal output from the sensor 103 changes from the High-level signal to the Low-level signal are the same or close. Therefore, the latter timing is presumed as the former timing. Therefore, the transit time measured by the controller 130 is presumed as a time from when the first ink chamber 36A and the second ink chamber 36B are brought into fluid communication with each other via the hollow tube 115 to when the detection signal output from the sensor 103 changes from the Low-level signal to the High-level signal.

According to this second modified embodiment, there is no need to provide a path in the ink cartridge 30 to bring the first ink chamber 36A into fluid communication with the second ink chamber 36B, the structure of the ink cartridge 30 can be simplified. It is preferable to position the first opening 40A close to the partitioning wall 45, e.g., at a lower portion of the first ink chamber 36A, and it is preferable to position the second opening 40B above the ink supply portion 60. As a result, ink can be consumed efficiently.

In another embodiment, each of the first opening 40A and the second opening 40B may be closed by a valve mechanism like the valve mechanism instead of the films 40C and 40D. When the ink cartridge 30 is mounted to the cartridge mounting portion 110, each of the first end 115A and the second end 115B of the hollow tube 115 pushes the movable member of the valve mechanism against the biasing force of the biasing member to open the first opening 40A and the second opening 40B.

In this second modified embodiment, although the mount sensor 107 can be removed, the cartridge mounting portion 110 can comprise the mount sensor 107. In such a case, the controller 130 may measure, as the transit time, a time from when the detection signal output from the mount sensor 107 changes from the Low-level signal to the High-level signal to when the detection signal output from the sensor 103 changes from the Low-level signal to the High-level signal.

In FIGS. 9 and 11A to 11C, there is no structure depicted to bring the second ink chamber 36B into fluid communication with the atmosphere. Air in the second ink chamber 36B may flow into the hollow tube 102. In addition or alternatively, the ink cartridge 30 may comprise a path for bringing the second ink chamber 36B into fluid communication with the atmosphere.

<Third Modified Embodiment>

Figure 12:
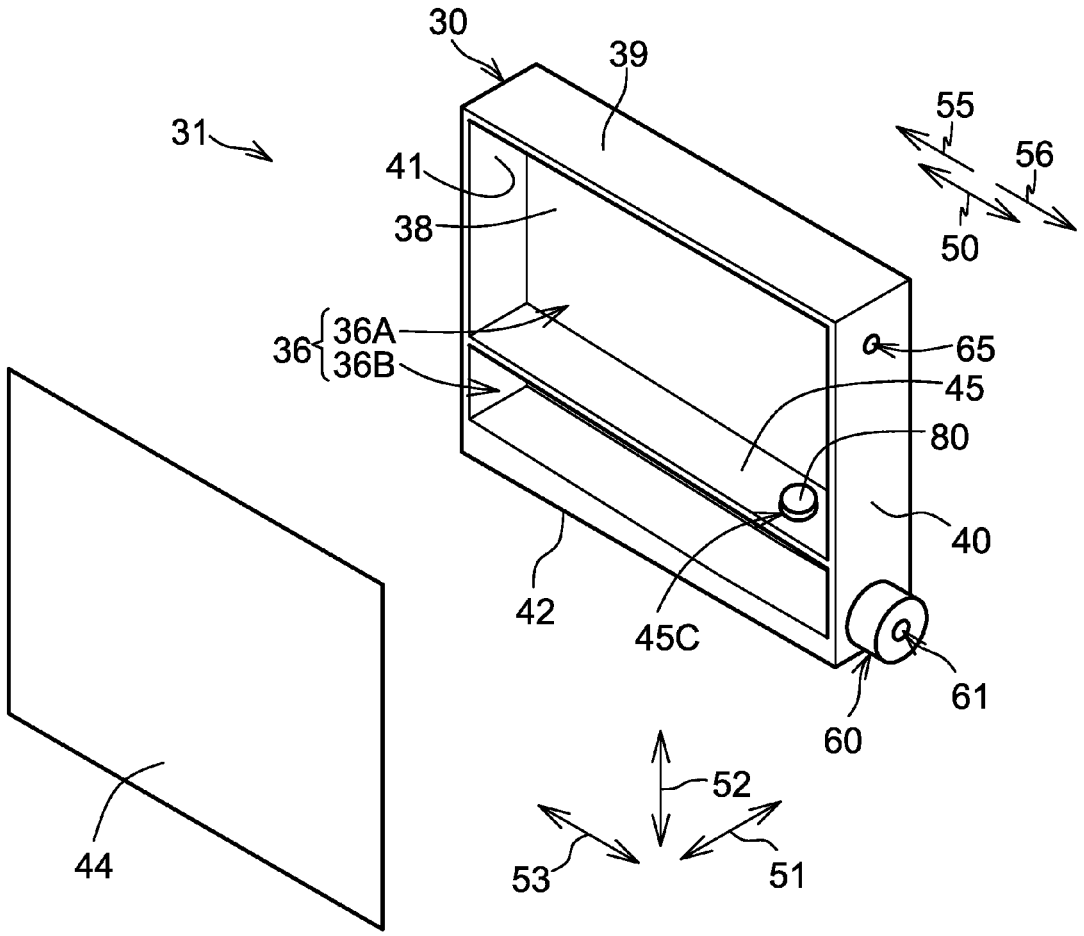
FIG. 12 is an exploded perspective view of an ink cartridge according to a third modified embodiment.
Figure 13A:
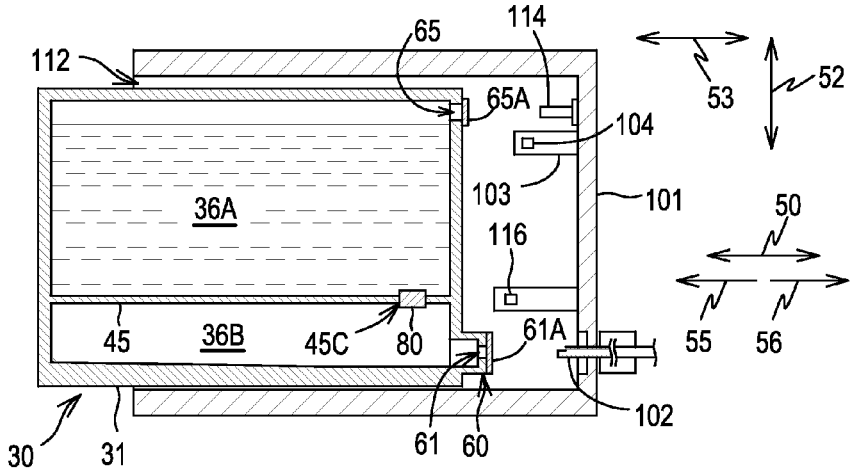
FIG. 13A is a cross-sectional view of the ink cartridge and a cartridge mounting portion according to the third modified embodiment during insertion of the ink cartridge into the cartridge mounting portion.
Figure 13B:
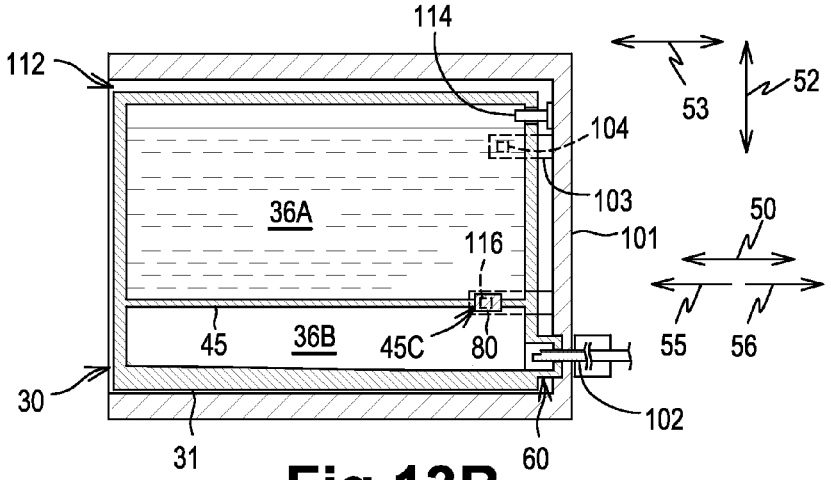
FIG. 13B is a cross-sectional view of the ink cartridge and the cartridge mounting portion according to the third modified embodiment when mounting of the ink cartridge to the cartridge mounting portion has been just completed.
Figure 13C:
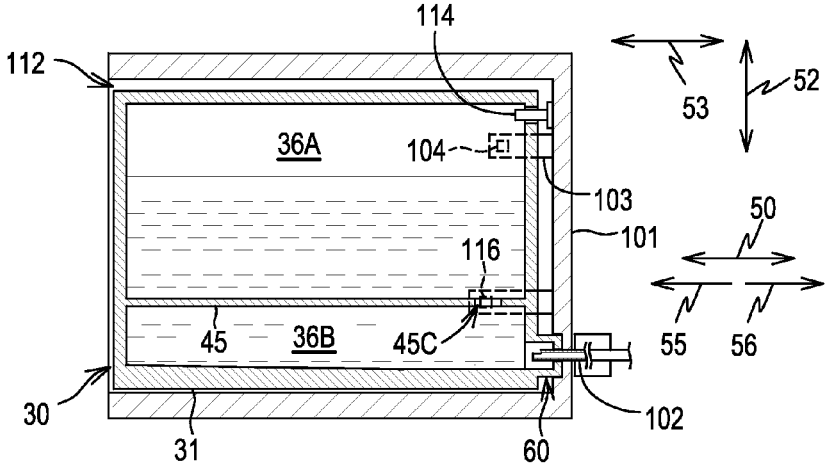
FIG. 13C is a cross-sectional view of the ink cartridge and the cartridge mounting portion according to the third modified embodiment when mounting of the ink cartridge to the cartridge mounting portion has been completed and the ink surface of a first ink chamber falls below a detection position.

Referring to FIGS. 12 to 13C, an ink cartridge 30 and a cartridge mounting portion 110 according to the third modified embodiment are described. Referring to FIG. 12, the partitioning wall 45 extends substantially in parallel with the top wall 39 and the bottom wall 42 and is connected to the front wall 40 and the rear wall 41. The partitioning wall 45 partitions the ink chamber 36 into the first ink chamber 36A and the second ink chamber 36B with respect to the height direction 52. The first ink chamber 36A and the second ink chamber 36B are aligned in the height direction 52 sandwiching the partitioning wall 45 therebetween. The second ink chamber 36B is positioned farther from the top wall 39 than the first ink chamber 36A is. Before the ink cartridge 30 is mounted to the cartridge mounting portion 110, the first ink chamber 36A stores a first initial amount of ink therein and the second ink chamber 36B stores a second initial amount of ink therein. In this second modified embodiment, the second initial amount of ink is zero, i.e., the second ink chamber 36B does not store ink therein. The ink supply portion 60 is provided at the front wall 40 at a position aligned with the second ink chamber 36B in the depth direction 53. The air communication opening 65 is provided at the front wall 40 at a position aligned with the first ink chamber 36A in the depth direction 53.

The communication opening 45C of the ink cartridge 30 according to this third modified embodiment extends through the partitioning wall 45 in the height direction 52. The communication opening 45C is closed by a plug 80. The plug 80 is made of a material which can be destroyed by ultrasonic irradiation. For instance, the plug 80 may be a metal film or resin, and the thickness thereof, i.e., the dimension in the height direction 52 may be less than the thickness of the partitioning wall 45. When the plug 80 is irradiated with ultrasonic wave, cavitation occurs around the plug 80 and thereby the plug 80 is destroyed.

Referring to FIGS. 13A to 13C, the cartridge mounting portion 110 comprises an ultrasonic irradiation device 116 positioned to face the ink cartridge 30 mounted to the cartridge mounting portion 110. When the ultrasonic irradiation device 116 receives a destroy signal from the controller 130, the ultrasonic irradiation device 116 irradiates the plug 80 with ultrasonic wave. When this occurs, the plug 80 is destroyed, and the first ink chamber 36A and the second ink chamber 36B are brought into fluid communication via the communication opening 45C. Subsequently, when the ink surface in the first ink chamber 36A falls below the detection position, the detection signal output from the sensor 103 changes from the Low-level signal to the High-level signal. The controller 130 measures, as the transit time, a time from when the controller 130 outputs the destroy signal to the ultrasonic irradiation device 116 to when the detection signal output from the sensor 103 changes from the Low-level signal to the High-level signal.

The timing when the first ink chamber 36A and the second ink chamber 36B are brought into fluid communication with each other via the communication opening 45C and the timing when the controller 130 outputs the destroy signal to the ultrasonic irradiation device 116 are the same or close. Therefore, the latter timing is presumed as the former timing. Therefore the transit time measured by the controller 130 is presumed as a time from when the first ink chamber 36A and the second ink chamber 36B are brought into fluid communication with each other via the communication opening 45C to when the detection signal output from the sensor 103 changes from the Low-level signal to the High-level signal.

According to this third modified embodiment, the measurement of the transit time is started when the controller 130 outputs the destroy signal to the ultrasonic irradiation device 116, the transit time may be measured more accurately. The material of the plug 80 is not limited to the one configured to be destroyed by ultrasonic irradiation. For instance, the plug 80 may be made of a material which can be destroyed by heat. In such a case, the material of the plug 80 has a melting point which is less than the melting point of the material of the frame 31. For instance, the frame 31 is made of polyethylene terephthalate (PET) and the plug 80 is made of polypropylene (PP). The ultrasonic irradiation device 160 is replaced with a heater.

In the third modified embodiment, the first ink chamber 36A and the second ink chamber 36B are brought into fluid communication after the mounting of the ink cartridge 30 to the cartridge mounting portion 110 is completed. On the other hand, in the above-described embodiment, the first modified embodiment, and the second modified embodiment, the first ink chamber 36A and the second ink chamber 36B are brought into fluid communication when or just before the mounting of the ink cartridge 30 to the cartridge mounting portion 110 is completed. The timing when he first ink chamber 36A and the second ink chamber 36B are brought into fluid communication is not limited to a specific timing.

<Fourth Modified Embodiment>

Figure 14A:
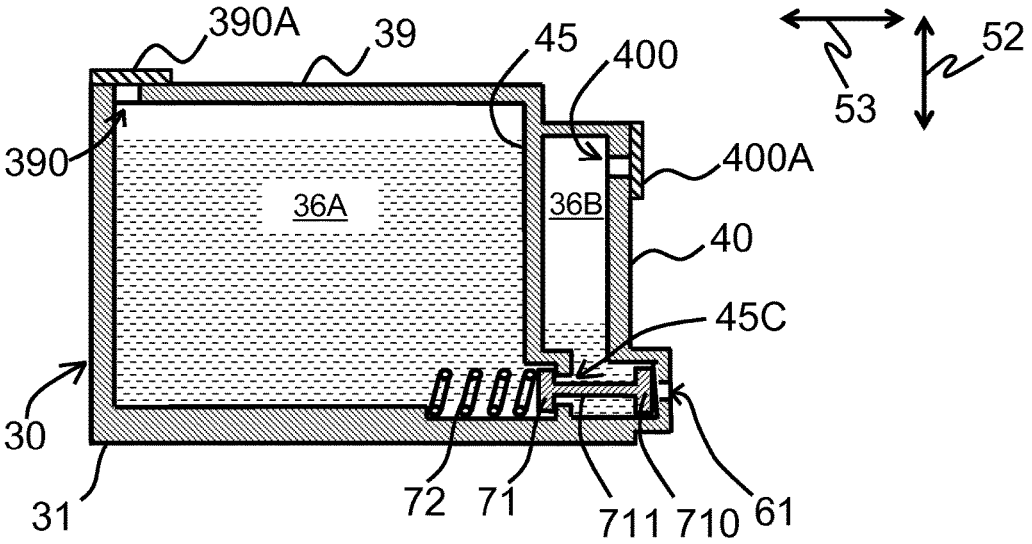
FIG. 14A is a cross-sectional view of an ink cartridge according to a fourth modified embodiment, in which a valve member is in a close position and a movable member is in a block position.
Figure 14B:
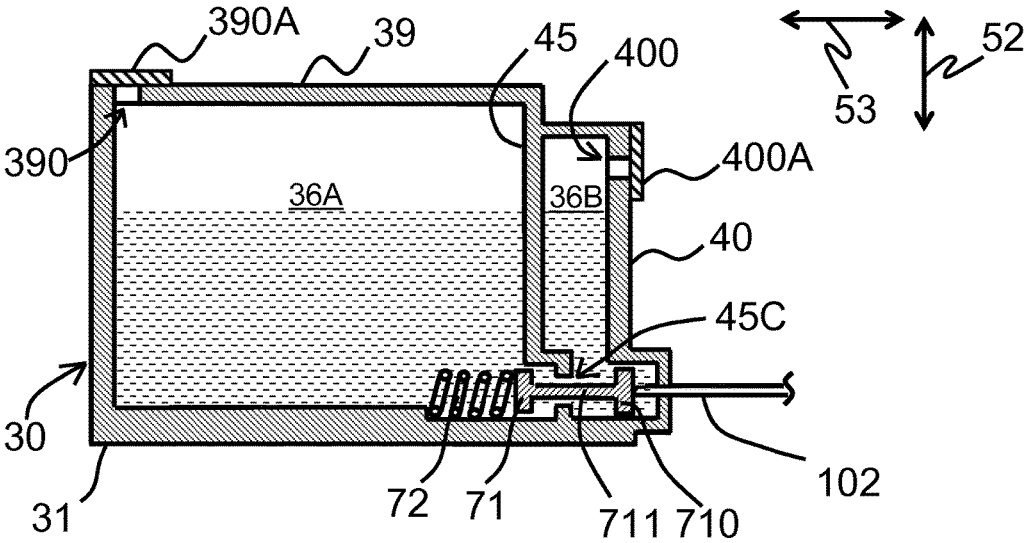
FIG. 14B is a cross-sectional view of the ink cartridge according to the fourth modified embodiment, in which the valve member is in an open position and the movable member is in a communication position.

Referring to FIGS. 14A and 14B, an ink cartridge 30 according to a fourth modified embodiment is described. The front wall 40 of the ink cartridge 30 has an opening 400 formed therethrough in the depth direction 53. The opening 400 is positioned closer to the upper end of the front wall 40 than to the lower end of the front wall 40. The ink cartridge 30 comprises an air permeable film 400A attached to the front outer face of the front wall 40 to cover the opening 400. The second ink chamber 36B is in air communication with the atmosphere outside the ink cartridge 30 via the opening 400 and the air permeable film 400A.

The top wall 39 of the ink cartridge 30 has an opening 390 formed therethrough in the height direction 52. The ink cartridge 30 comprises an air permeable film 390A attached to the top outer face of the top wall 39 to cover the opening 390. The first ink chamber 36A is in air communication with the atmosphere outside the ink cartridge 30 via the opening 390 and the air permeable film 390A.

The ink cartridge 30 comprises a valve member 710 which is movable between a close position as shown in FIG. 14A and an open position as shown in FIG. 14.B in the depth direction 53. When the valve member 710 is in the close position, the valve member 710 contacts a wall surrounding the ink supply opening 61 and thereby closes the ink supply opening 61. When the valve member 710 is in the open position, the valve member 710 is positioned away from the wall surrounding the ink supply opening 61 and thereby opens the ink supply opening 61. The ink cartridge 30 comprises a connection portion 711 extending from the valve member 710 to the movable member 71 in the depth direction 53, and the movable member 71 is connected to the valve member 710 via the connection portion 711. The coil spring 72 biases the movable member 71 into the block position, and also biases the valve member 710 into the close position via the connection portion 711 as shown in FIG. 14A.

Referring to FIG. 14B, when the hollow tube 102 is inserted through the ink supply opening 61, the hollow tube 102 contacts and pushes the valve member 710, and also pushes the movable member 71 via the connection portion 711. When this occurs, the valve member 710 moves to the open position, and at the same time the movable member 71 moves to the communication position. Ink flows from the first ink chamber 36A into the second ink chamber 36B via the communication opening 45C and flows into the hollow tube 102.

In this embodiment, referring to FIG. 14A, before the ink cartridge 30 is mounted to the cartridge mounting portion 110, i.e., when the movable member 71 is in the block position, the second initial amount of ink in the second ink chamber 36B is not zero, and the first initial ink surface of the first initial amount of ink in the first ink chamber 36A is positioned above the second initial ink surface of the second initial amount of ink in the second ink chamber 36B. Nevertheless, in another embodiment, the second initial amount may be zero. The ink surface in the first ink chamber 36A moves down and the ink surface in the second ink chamber 36B moves up as ink moves from the first ink chamber 36A to the second ink chamber 36B. Finally the height of the ink surface in the first ink chamber 36A and the height of the ink surface in the second ink chamber 36B becomes the same as shown in the FIG. 14B.

<Fifth Modified Embodiment>

Figure 15A:
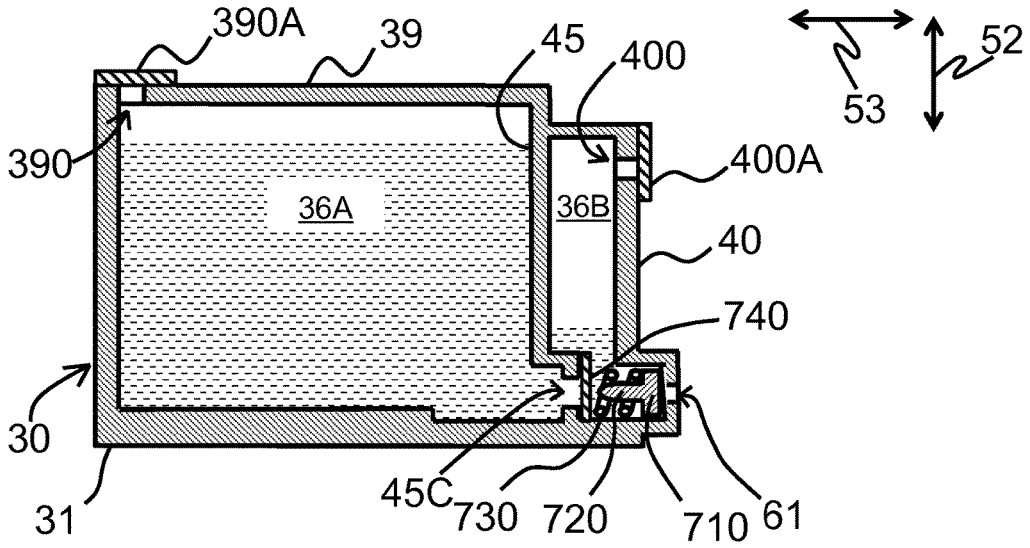
FIG. 15A is a cross-sectional view of an ink cartridge according to a fifth modified embodiment, in which a pointed member is in a standby position.
Figure 15B:
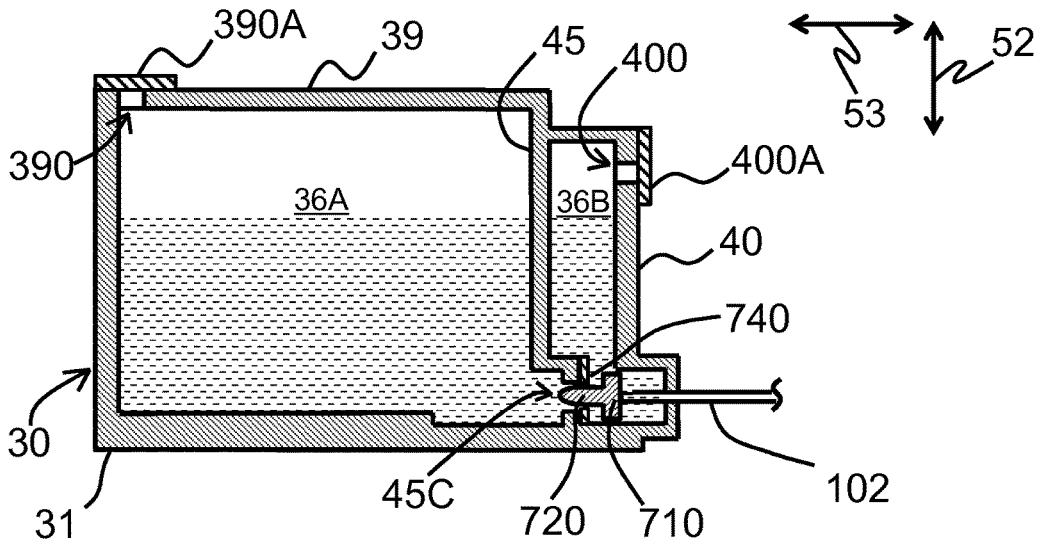
FIG. 15B is a cross-sectional view of the ink cartridge according to the fifth modified embodiment, in which the pointed member is in a rupture position.

Referring to FIGS. 15A and 15B, an ink cartridge 30 according to a fifth modified embodiment is described. The ink cartridge 30 according to this fifth modified embodiment is similar to the ink cartridge 30 according to the fourth modified embodiment, but does not comprise the movable member 71 and the coil spring 72.

The ink cartridge 30 comprises a rupturable wall, e.g., a film 740 attached to the wall surrounding the communication opening 45C to close the communication opening 45C. The ink supply opening 61 extends in the depth direction 53, and the ink supply opening 61 and the film 740 are aligned in the depth direction 53. The ink cartridge 30 comprises a biasing member, e.g., a coil spring 730 positioned between the wall surrounding the communication opening 45C and the valve member 710. The coil spring 730 biases the valve member 710 into the close position.

The ink cartridge 30 comprises a pointed member 720 extending from the valve member 710 toward the film 740. The pointed member 720 is movable between a standby position as shown in FIG. 15A and a rupture position as shown in FIG. 15B. When the pointed member 720 moves from the standby position to the rupture position, the pointed member 720 penetrates and ruptures the film 740 so as to open the communication opening 45C. When the valve member 710 is in the close position, the pointed member is in the standby position. When the valve member 710 is in the open position, the pointed member is in the rupture position.

Referring to FIG. 15B, when the hollow tube 102 is inserted through the ink supply opening 61, the hollow tube 102 contacts and pushes the valve member 710 and the pointed member 720. When this occurs, the valve member 710 moves to the open position, and at the same time the pointed member moves to the rupture position. Ink flows from the first ink chamber 36A into the second ink chamber 36B via the communication opening 46C and flows into the hollow tube 102.

The ink cartridge 30 may not have the valve member 710 and the pointed member 720. In such a case, the ink cartridge 30 comprises the film 61A to close the ink supply opening 61 as in the above-described embodiment. When the hollow tube 102 is inserted through the film 61A and the ink supply opening 61, the hollow tube 102 penetrates and ruptures the film 740 so as to open the communication opening 45C.

<Sixth Modified Embodiment>

Figure 16A:
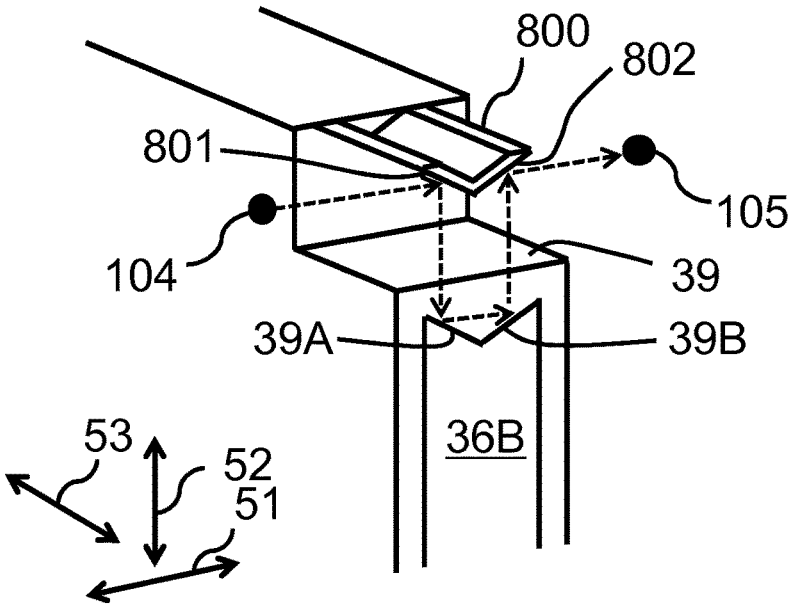
FIG. 16A is a partial perspective view of an ink cartridge according to a sixth modified embodiment, in which the ink cartridge is cut along a plane which is parallel with the width direction 51 and the height direction 52, and an ink surface of a second ink chamber does not reach a detection position.
Figure 16B:
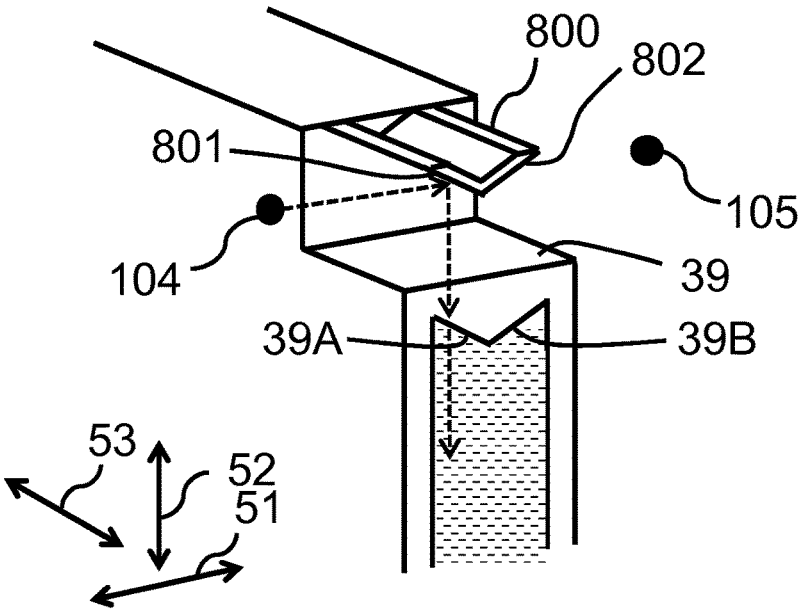
FIG. 16B is a partial perspective view of the ink cartridge according to the sixth modified embodiment, in which the ink cartridge is cut along a plane which is parallel with the width direction 51 and the height direction 52, and the ink surface of the second ink chamber reaches a detection position.

Referring to FIGS. 16A and 16B, an ink cartridge 30 according to a sixth modified embodiment is described. The ink cartridge 30 according to this sixth modified embodiment is similar to the ink cartridge 30 according to the fourth modified embodiment or the ink cartridge 30 according to the fifth modified embodiment, but comprises a reflective member 800 positioned above a portion of the top wall 39 defining the second ink chamber 36B.

The reflective member 800 comprises a first reflective surface 801 and a second reflective surface 802, each extending in the depth direction 53. Each of the first reflective surface 801 and the second reflective surface 802 has an aluminum film formed thereon by sputtering or non-electrolytic plating. When the ink cartridge 30 is mounted to the cartridge mounting portion 110, the reflective member 800 is positioned between the light emitting portion 104 and the light receiving portion 105. The first reflective surface 801 is inclined with respect to the width direction 51 and the height direction 52, such that light emitted by the light emitting portion 104 and traveling in the width direction 52 is reflected on the first reflective surface 801 downward and toward the portion of the top wall 39 defining the second ink chamber 36B. The second reflective surface 802 is inclined with respect to the width direction 51 and the height direction 52, such that light traveling upward from the portion of the top wall 39 defining the second ink chamber 36B is reflected on the second reflective surface 802 in the width direction 51 toward the light receiving portion 105. The first reflective surface 801 and the second reflective surface 802 are symmetrical with respect to a plane parallel with the height direction 52 and the depth direction 53. The first reflective surface 801 and the second reflective surface 802 are arrange in a V shape.

The portion of the top wall 39 defining the second ink chamber 36B is made of a material which allows light to pass therethrough, e.g., polypropylene resin, acrylic resin, polycarbonate resin, glass, etc. In other words, the portion of the top wall 39 defining the second ink chamber 36B is light-transmissive. The portion of the top wall 39 defining the second ink chamber 36B comprises a first inclined surface 39A and a second inclined surface 39B. The first inclined surface 39A and the second inclined surface 39B extend in the depth direction 53 and are inclined with respect to the width direction 51 and the height direction 52. The first inclined surface 39A and the second inclined surface 39B are symmetrical with respect to a plane parallel with the height direction 52 and the depth direction 53. The first inclined surface 39A and the second inclined surface 39B are arranged in a V shape. The top outer surface of the portion of the top wall 39 defining the second ink chamber 36B extends in the width direction 51 and the depth direction 53.

Each of the first inclined surface 39A and the second inclined surface 39B has a first reflectance R1 for light passing through the top wall 39 when not contacting ink in the second ink chamber 36B and has a second reflectance R2 for light passing through the top wall 39 when contacting ink in the second ink chamber 36B. The first reflectance R1 and the second reflectance R2 are different. Because the difference between the refractive index of air and the refractive index of the top wall 39 is relatively large, when the first inclined surface 39A and the second inclined surface 39B does not contact ink but contact air in the second ink chamber 36B, light mostly is reflected on the first inclined surface 39A and the second inclined surface 39B. In other words, the first reflectance R1 is relatively high. On the other hand, because the difference between the refractive index of ink and the refractive index of the top wall 39 is relatively small, when the first inclined surface 39A and the second inclined surface 39B contact ink, light mostly pass through the first inclined surface 39A and the second inclined surface 39B. In other words, the second reflectance R2 is relatively low.

Referring to FIG. 16A, just after the mounting of the ink cartridge 30 to the cartridge mounting portion 110 is completed, ink has not reached the first inclined surface 39A and the second inclined surface 39B. Light emitted by the light emitting portion 104 travels in the width direction 51 toward the first reflective surface 801. The light is reflected on the first reflective surface 801 and travels downward in the height direction 52. The light then enters the top wall 39 and travels toward the first inclined surface 39A. The light is then reflected on the first inclined surface 39A because the first inclined surface 39A does not contact ink. The light then travels in the width direction 51 toward the second inclined surface 39B. The light is then reflected on the second inclined surface 39B because the second inclined surface does not contact ink. The light then travels upward in the height direction 52 and comes out of the top wall 39. The light then is reflected on the second reflective surface 802 and travels in the width direction 51 toward the light receiving portion 105. The light receiving portion 105 receives the light, and the sensor 103 outputs the High level signal. The path of the light is depicted by arrows in FIG. 16A.

Referring to FIG. 16B, as ink moves from the first ink chamber 36A to the second ink chamber 36B, the ink surface in the second ink chamber 36B moves up and contacts the first inclined surface 39A and second inclined surface 39B. Light emitted by the light emitting portion 104 travels in the width direction 51 toward the first reflective surface 801. The light is reflected on the first reflective surface 801 and travels downward in the height direction 52. The light then enters the top wall 39 and travels toward the first inclined surface 39A. The light then mostly passes through the first inclined surface 39A into the second ink chamber 36B because the first inclined surface 39A contacts ink. Little or no light reaches the light receiving portion 105. The sensor 103 outputs the Low level signal. The path of the light is depicted by arrows in FIG. 16B. In this sixth modified embodiment, the position where the first inclined surface 39A and the second inclined surface 39B are located is a detection position.

In this sixth modified embodiment, the difference of the refractive index determines whether light is reflected or not. Therefore, ink does not have to block light, but may allow light to pass therethrough.

<Seventh Modified Embodiment>

Figure 17A:
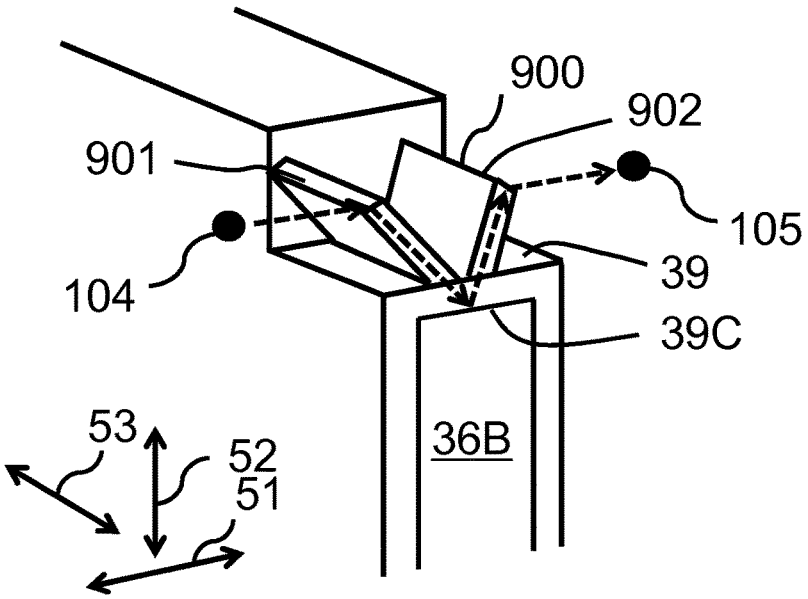
FIG. 17A is a partial perspective view of an ink cartridge according to a seventh modified embodiment, in which the ink cartridge is cut along a plane which is parallel with the width direction 51 and the height direction 52, and an ink surface of a second ink chamber does not reach a detection position.
Figure 17B:
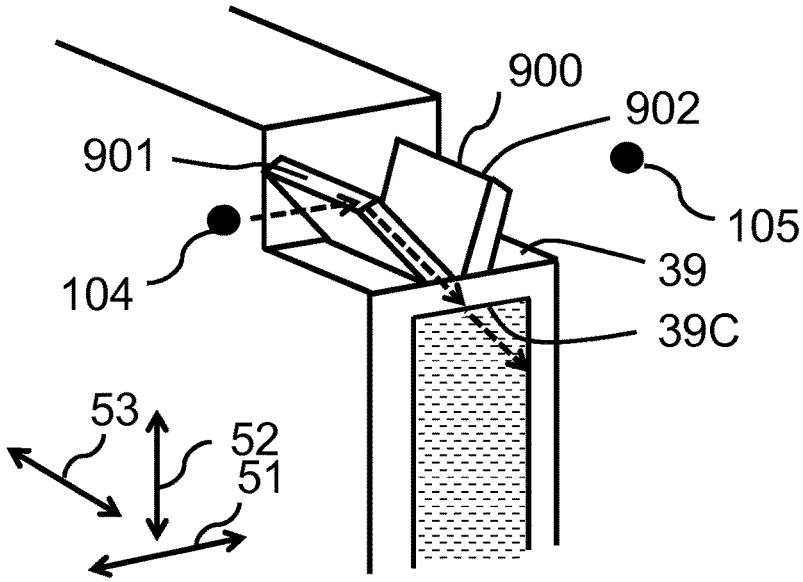
FIG. 17B is a partial perspective view of the ink cartridge according to the seventh modified embodiment, in which the ink cartridge is cut along a plane which is parallel with the width direction 51 and the height direction 52, and the ink surface of the second ink chamber reaches a detection position.

Referring to FIGS. 17A and 17B, an ink cartridge according to a seventh modified embodiment is described. The ink cartridge 30 according to this seventh modified embodiment is similar to the ink cartridge 30 according to the sixth modified embodiment, but may comprise a light guiding member 900 instead of reflective member 800.

The light guiding member 900 is configured to guide light toward the portion of the top wall 39 defining the second ink chamber 36B. The light guiding member 900 comprises a first light guiding plate 901 and a second light guiding plate 902, each extending in the depth direction 53. Each of the first light guiding plate 901 and the second light guiding plate 902 are made of a material which allows light to pass therethrough, e.g., polypropylene resin, acrylic resin, polycarbonate resin, glass, etc. When the ink cartridge 30 is mounted to the cartridge mounting portion 110, the light guiding member 900 is positioned between the light emitting portion 104 and the light receiving portion 105. The first light guiding plate 901 and the second light guiding plate 902 are inclined with respect to the width direction 51 and the height direction 52. The first light guiding plate 901 and the second light guiding plate 902 are symmetrical with respect to a plane parallel with the height direction 52 and the depth direction 53. The first light guiding plate 901 and the second light guiding plate 902 are arranged in a V shape. The lower ends of the first guiding plate 901 and the second guiding plate 902 are connected to the top outer surface of the portion of the top wall 39 defining the second ink chamber 36B. Preferably, the first guiding plate 901 and the second guiding plate 902 are integrally formed with the top wall 39.

The portion of the top wall 39 defining the second ink chamber 36B comprises an inner surface 39C facing the second ink chamber 36B. The inner surface 39C extends in the width direction 51 and the depth direction 53. The inner surface 39C has the first reflectance R1 for light passing through the top wall 39 when not contacting ink in the second ink chamber 36B and has the second reflectance R2 for light passing through the top wall 39 when contacting ink in the second ink chamber 36B, similarly to the first inclined surface 39A and the second inclined surface 39B of the sixth modified embodiment.

Referring to FIG. 17A, just after the mounting of the ink cartridge 30 to the cartridge mounting portion 110 is completed, ink has not reached the inner surface 39C. Light emitted by the light emitting portion 104 travels in the width direction 51 and enters the first light guiding plate 901 from the upper end of the first light guiding plate 901. The light then travels in the light guiding plate 901 obliquely downward toward the top wall 39. The light then enters the top wall 39 and travels toward the inner surface 39C. The light is then reflected on the inner surface 39C because the inner surface 39C does not contact ink. The light then travels in the top wall 39 and in the second light guiding plate 902 obliquely upward. The light then comes out of the second light guiding plate 902 from the upper end of the light guiding plate 902 and moves in the width direction 51 toward the light receiving portion 105. The light receiving portion 105 receives the light, and the sensor 103 outputs the High level signal. The path of the light is depicted by arrows in FIG. 17A.

Referring to FIG. 17B, as ink moves from the first ink chamber 36A to the second ink chamber 36B, the ink surface in the second ink chamber 36B moves up and contacts the inner surface 39C. Light emitted by the light emitting portion 104 travels in the width direction 51 and enters the first light guiding plate 901 from the upper end of the first light guiding plate 901. The light then travels in the light guiding plate 901 obliquely downward toward the top wall 39. The light then enters the top wall 39 and travels toward the inner surface 39C. The light then mostly passes through the inner surface 39C into the second ink chamber 36B because the inner surface 39C contacts ink. Light or no light reaches the light receiving portion 105. The sensor 103 outputs the Low level signal. The path of the light is depicted by arrows in FIG. 17B. In this seventh modified embodiment, the position where the inner surface 39C is located is a detection position.

In the above-described embodiment and the first to seventh modified embodiments, ink is an example of liquid. Nevertheless, liquid is not limited to ink. For instance, liquid can be pre-treatment liquid which is ejected onto the sheet of paper before ink is ejected in printing.

In the above-described embodiment and the first to seventh modified embodiments, the ink cartridge 30 is manually mounted to the cartridge mounting portion 110. Nevertheless, how to mount the ink cartridge 30 to the cartridge mounting portion 110 is not limited to the manual mounting. An auto-loading mechanism can be provided to the cartridge mounting portion 110. For instance, with the auto-loading mechanism, a user has only to insert the ink cartridge 30 halfway into the cartridge mounting portion 110. Afterwards, the ink cartridge 30 is automatically moved in the insertion direction 56, and finally the mounting of the ink cartridge 30 to the cartridge mounting portion 110 is completed. Therefore, there is a reduced likelihood that the sensor 103 cannot detect the movement of the ink surface even if the first ink chamber 36A and the second ink chamber 36B are brought into fluid communication with each other.

While the invention has been described in connection with various example structures and illustrative embodiments, it will be understood by those skilled in the art that other variations and modifications of the structures and embodiments described above may be made without departing from the scope of the invention. Other structures and embodiments will be understood by those skilled in the art from a consideration of the specification or practice of the invention disclosed herein. It is intended that the specification and the described examples are merely illustrative and that the scope of the invention is defined by the following claims.

The invention claimed is:

1. A liquid cartridge comprising:

a liquid chamber having an air communication opening configured to provide communication between an interior of the liquid chamber and an atmosphere of an exterior of the liquid chamber to equalize a pressure of the interior of the liquid chamber with a pressure of the exterior of the liquid chamber, a liquid supply portion selectively providing liquid communication from an interior of the liquid chamber to an exterior of the liquid chamber, the liquid supply portion and the air communication opening being disposed at a same side of the liquid chamber;

a partitioning wall partitioning the liquid chamber into a first liquid chamber and a second liquid chamber, a communication opening selectively providing fluid communication between the first liquid chamber and the second liquid chamber; and a movable member which is movable between a block position and a communication position, wherein when the movable member is in the block position, the movable member blocks the communication opening, and when the movable member is in the communication position, the communication opening is opened to provide fluid communication between the first liquid chamber and the second liquid chamber, and wherein the movable member is configured to move from the block position to the communication position in response to the cartridge being received by a cartridge mounting portion.

2. The liquid cartridge of claim 1, wherein the liquid supply portion has a liquid supply opening extending in a first direction, wherein the liquid supply opening and the movable member are aligned in the first direction.

3. The liquid cartridge of claim 1, further comprising a valve member which is movable between a close position and an open position, wherein the liquid supply portion has a liquid supply opening, wherein when the valve member is in the close position, the valve member is configured to close the liquid supply opening, and when the valve member is in the open position, the valve member is configured to open the liquid supply opening, wherein when the valve member is in the close position, the movable member is in the block position, and when the movable member is in the open position, the movable member is in the communication position.

4. The liquid cartridge of claim 3, wherein the movable member is connected to the valve member.

5. The liquid cartridge of claim 1, wherein the liquid chamber is positioned between a first outer face and a second outer face, the liquid supply portion being positioned at the first outer face, and wherein the movable member is closer to the second outer face when in the communication position than when in the block position.

6. The liquid cartridge of claim 1, wherein the movable member contacts the partitioning wall when in the block position.

7. The liquid cartridge of claim 1, further comprising a wall defining the second liquid chamber, and the wall defining the second liquid chamber is configured to allow light to pass therethrough, wherein the wall defining the second liquid chamber comprises a surface, and the surface has a first reflectance for light passing through the wall defining the second liquid chamber when the surface does not contact the liquid in the second liquid chamber, and the surface has a second reflectance for the light passing through the wall defining the second liquid chamber when the surface contacts the liquid in the second liquid chamber, wherein the first reflectance is different from the second reflectance.

8. The liquid cartridge of claim 7, wherein the wall defining the second liquid chamber is positioned above the second liquid chamber.

9. The liquid cartridge of claim 7, further comprising a reflective member configured to reflect light toward the wall defining the second liquid chamber.

10. The liquid cartridge of claim 7, further comprising a light guiding member configured to guide light toward the wall defining the second liquid chamber.

11. The liquid cartridge of claim 1, wherein a portion of the first liquid chamber and a portion of the second liquid chamber are positioned above the communication opening.

12. The liquid cartridge of claim 11, wherein the communication opening is positioned in a lower half portion of the liquid cartridge, and the portion of the first liquid chamber and the portion of the second liquid chamber are positioned in an upper half portion of the liquid cartridge.

13. The liquid cartridge of claim 1, further comprising a biasing member configured to bias the movable member in the block position, wherein when the movable member is initially in the block position, the first liquid chamber stores the liquid therein and the second liquid chamber does not store the liquid therein.

14. The liquid cartridge of claim 1, wherein when the movable member is initially in the block position, the first liquid chamber has a first initial amount of the liquid having a first initial liquid surface and the second liquid chamber has a second initial amount of the liquid having a second initial liquid surface, wherein the first initial liquid surface is positioned above the second initial liquid surface.

* * * * *